US008960848B2

(12) United States Patent
Yokouchi

(10) Patent No.: US 8,960,848 B2
(45) Date of Patent: Feb. 24, 2015

(54) LIQUID EJECTION HEAD, LIQUID EJECTION APPARATUS AND ABNORMALITY DETECTION METHOD FOR LIQUID EJECTION HEAD

(75) Inventor: Tsutomu Yokouchi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 137 days.

(21) Appl. No.: 13/616,907

(22) Filed: Sep. 14, 2012

(65) Prior Publication Data

US 2013/0070012 A1 Mar. 21, 2013

(30) Foreign Application Priority Data

Sep. 21, 2011 (JP) ..... 2011-206317

(51) Int. Cl.

| | |
|---|---|
| ***B41J 29/393*** | (2006.01) |
| ***B41J 29/38*** | (2006.01) |
| ***B41J 2/14*** | (2006.01) |
| ***B41J 2/16*** | (2006.01) |

(52) U.S. Cl.

CPC ..... *B41J 2/14153* (2013.01); *B41J 2/14233* (2013.01); *B41J 2/1603* (2013.01); *B41J 2/161* (2013.01); *B41J 2/1623* (2013.01); *B41J 2/1626* (2013.01); *B41J 2/1631* (2013.01); *B41J 2002/14354* (2013.01)

USPC ..... 347/19; 347/14

(58) Field of Classification Search

CPC .... B41J 2/2142; B41J 2/16579; B41J 2/2139; B41J 29/393; B41J 2/0451

USPC ..... 347/14, 19

See application file for complete search history.

(56) References Cited

U.S. PATENT DOCUMENTS

| | | | | |
|---|---|---|---|---|
| 7,347,532 | B2 | 3/2008 | Chen et al. | |
| 7,422,315 | B2 * | 9/2008 | Hori | 347/71 |
| 2003/0085938 | A1 | 5/2003 | Imanaka et al. | |
| 2005/0212147 | A1 | 9/2005 | Nishizawa | |
| 2006/0284914 | A1 | 12/2006 | Murakami et al. | |
| 2007/0278181 | A1 | 12/2007 | Tsuboi et al. | |

FOREIGN PATENT DOCUMENTS

| | | | |
|---|---|---|---|
| JP | H06-323974 | A | 11/1994 |
| JP | 2000-263796 | A | 9/2000 |
| JP | 2000-269431 | A | 9/2000 |
| JP | 2000-343701 | A | 12/2000 |
| JP | 2005-277338 | A | 10/2005 |
| JP | 2006-289919 | A | 10/2006 |

(Continued)

OTHER PUBLICATIONS

An Office Action; "Notification of Reasons for Rejection," issued by the Japanese Patent Office on Aug. 22, 2013, which corresponds to Japanese Patent Application No. 2011-206317 and is related to U.S. Appl. No. 13/616,907; with partial translation.

*Primary Examiner* — Jannelle M Lebron

(74) *Attorney, Agent, or Firm* — Studebaker & Brackett PC

(57) ABSTRACT

A liquid ejection head includes: a nozzle plate formed with a nozzle aperture through which liquid is ejected; and a flow channel plate formed with at least a flow channel connected to the nozzle aperture, the flow channel plate being bonded to the nozzle plate with the flow channel aligned to the nozzle aperture in the nozzle plate, wherein the nozzle plate is provided with a detection element configured to detect a mechanical abnormality in the nozzle plate.

2 Claims, 15 Drawing Sheets

(56) References Cited

FOREIGN PATENT DOCUMENTS

| | | | |
|---|---|---|---|
| JP | 2007-001035 | A | 1/2007 |
| JP | 2007-021854 | A | 2/2007 |
| JP | 2007-196455 | A | 8/2007 |
| JP | 2008-006809 | A | 1/2008 |
| JP | 2010-069618 | A | 4/2010 |

* cited by examiner

LIQUID EJECTION HEAD, LIQUID EJECTION APPARATUS AND ABNORMALITY DETECTION METHOD FOR LIQUID EJECTION HEAD

BACKGROUND OF THE INVENTION

1. Field of the Invention

The present invention relates to a liquid ejection head, a liquid ejection apparatus and an abnormality detection method for a liquid ejection head, and more particularly, to a structure of a liquid ejection head and detection technology for detecting a mechanical abnormality, such as cracking or deformation, of a nozzle plate.

2. Description of the Related Art

In recent years, there have been demands for high-resolution image formation in inkjet recording apparatuses. In order to achieve this requirement, semiconductor processing technique is employed for forming nozzle apertures, through which ink droplets are ejected, in a nozzle plate made of silicon, for example, and the nozzle apertures are processed with higher definition and are arranged at higher density in the nozzle plate.

However, in general, silicon plates are liable to crack upon receiving external impacts or stresses. If the nozzle plate cracks, then ink leakage is liable to occur from the flow channels and liquid chambers arranged on the opposite side of the ink ejection surface.

On the other hand, metal plates and resin plates are liable to be deformed upon receiving external impacts or stresses. If the nozzle plate is deformed, deformation of the nozzle apertures and variation in the orientations of the nozzle apertures, and the like, occur and affect the ink ejection characteristics.

U.S. Pat. No. 7,347,532 to Chen et al. relates to technology for forming nozzle apertures by means of semiconductor processing technique on silicon nozzle plates, but is silent about the problem of cracking of the silicon nozzle plates and mechanical abnormalities in the resin nozzle plate or metal nozzle plate.

SUMMARY OF THE INVENTION

The present invention has been contrived in view of these circumstances, an object thereof being to provide a liquid ejection head, a liquid ejection apparatus and an abnormality detection method for a liquid ejection head whereby a mechanical abnormality such as cracking or deformation of a nozzle plate can be detected.

In order to attain the aforementioned object, the present invention is directed to a liquid ejection head, comprising: a nozzle plate formed with a nozzle aperture through which liquid is ejected; and a flow channel plate formed with at least a flow channel connected to the nozzle aperture, the flow channel plate being bonded to the nozzle plate with the flow channel aligned to the nozzle aperture in the nozzle plate, wherein the nozzle plate is provided with a detection element configured to detect a mechanical abnormality in the nozzle plate.

According to this aspect of the present invention, by detecting the mechanical abnormality, such as cracking or deformation, in the nozzle plate, then necessary processing, such as halting the operation of the liquid ejection head, can be carried out and damage caused by the mechanical abnormality of the nozzle plate can be minimized.

The "mechanical abnormality in the nozzle plate" means a defect caused by mechanical impact or stress received by the nozzle plate, such as cracks, defects, distortion, or the like, in the nozzle plate.

The detection element can be arranged over the whole surface of the nozzle plate or in a portion of the nozzle plate.

The "flow channel" includes any structure through which the liquid passes, such as a nozzle flow channel connected to the nozzle aperture and a pressure chamber connected to the nozzle flow channel, and the like.

Preferably, a first surface of the nozzle plate is bonded with the flow channel plate; and the detection element includes at least one of a first electrical wire arranged on the first surface of the nozzle plate and a second electrical wire arranged on a second surface of the nozzle plate opposite to the first surface.

According to this aspect of the present invention, it is possible to detect the mechanical abnormality in the nozzle plate in accordance with change in the resistance value of the electrical wire.

Preferably, a line linking a start end and a finish end of the first electrical wire intersects with a line linking a start end and a finish end of the second electrical wire.

According to this aspect of the present invention, by arranging the electrical wires respectively on the first surface and the second surface of the nozzle plate, and also arranging the first and second electrical wires in intersecting directions, it is possible to identify the mechanical abnormality which occurs in a planar direction of the nozzle plate.

Preferably, the liquid ejection head further comprises a first insulating layer which has electrical insulating properties and covers the second electrical wire.

According to this aspect of the present invention, it is possible to prevent insulation defects or corrosion by the liquid ejected from the nozzle aperture formed in the nozzle plate.

Preferably, the nozzle plate has electrical conducting properties; and the liquid ejection head further comprises a second insulating layer which has electrical insulating properties and is arranged between the nozzle plate and the at least one of the first and second electrical wires.

According to this aspect of the present invention, if the nozzle plate is a conductive member or if another electrical wire is formed on the nozzle plate, electrical insulating properties between the nozzle plate and other electrical wire is guaranteed.

Preferably, the flow channel plate has a liquid chamber and a flow channel, the liquid chamber connecting to the nozzle aperture in the nozzle plate, the flow channel connecting to the liquid chamber; and the at least one of the first and second electrical wires is arranged to intersect with the flow channel.

According to this aspect of the present invention, if the flow channel is formed in the rear face of the nozzle plate, then cracking or deformation is liable to occur in a position corresponding to the flow channel in the nozzle plate, and by arranging the electrical wire in the portion where cracking or deformation is liable to occur, it is possible to improve the detection accuracy of cracking or deformation in the nozzle plate.

Preferably, the at least one of the first and second electrical wires has a shape formed of a broad width section and a narrow width section, the broad width section including a portion of greatest width, the narrow width section having a width less than that of the broad width section.

According to this aspect of the present invention, since the narrow width section is liable to produce deformation or severance, then it is possible to improve the detection sensitivity.

Preferably, the flow channel plate has a liquid chamber and a flow channel, the liquid chamber connecting to the nozzle aperture in the nozzle plate, the flow channel connecting to the liquid chamber; the at least one of the first and second electrical wires is arranged to intersect with the flow channel; the at least one of the first and second electrical wires has a shape formed of a broad width section and a narrow width section, the broad width section including a portion of greatest width, the narrow width section having a width less than that of the broad width section; and the narrow width section is arranged at a position corresponding to the flow channel.

According to this aspect of the present invention, by forming the narrow width section having high detection accuracy in the position on the nozzle plate where the flow channel is formed in the rear surface and hence where cracking or the like is liable to occur, it is possible to achieve detection of greater accuracy and higher sensitivity.

Preferably, a first surface of the nozzle plate is bonded with the flow channel plate; and the detection element includes an electrostrictive element arranged on at least one of the first surface of the nozzle plate and a second surface of the nozzle plate opposite to the first surface.

According to this aspect of the present invention, since the electrical signal is generated by the electrostrictive element due to the occurrence of mechanical deformation in the electrostrictive element as a result of the mechanical abnormality in the nozzle plate, then a mechanical abnormality in the nozzle plate is detected on the basis of this electrical signal.

One example of the "electrostrictive element" in this mode is a piezoelectric element in which a first electrode is arranged on one surface and a second electrode is arranged on another surface.

Preferably, the nozzle plate is provided with an electrical signal extraction unit to which an extraction wire that transmits an electrical signal obtained from the detection element is bonded.

According to this aspect of the present invention, a wiring pattern electrically connected to the detection element and the electrical signal extraction unit is formed in the nozzle plate.

Preferably, the nozzle plate has an end section of which a corner has been chamfered to have an inclined surface; the electrical signal extraction unit is arranged on the inclined surface; and the extraction wire has a shape corresponding to the inclined surface of the nozzle plate, in a portion where the extraction wire is bonded to the nozzle plate.

According to this aspect of the present invention, the extraction wire does not project beyond the surface of the nozzle plate where the extraction wire is attached.

Preferably, the liquid ejection head further comprises a cover member which covers the electrical signal extraction unit.

According to this aspect of the present invention, breakage of the electrical signal extraction unit due to wiping of the nozzle plate, or the like, is prevented.

Preferably, the liquid ejection head includes a plurality of head modules joined together in a lengthwise direction of the liquid ejection head; and the extraction wire is bonded to an end section of each of the head modules in a breadthwise direction of the liquid ejection head.

According to this aspect of the present invention, even if the gap between adjacent head modules is narrow and there is no space to bond the extraction wires, it is still possible to bond the extraction wires without applying mechanical stress to the extraction wires.

It is also preferable that the liquid ejection head includes a plurality of head modules arranged in two staggered rows along a lengthwise direction of the liquid ejection head; and the extraction wire is bonded to an end section of each of the head modules in one of the lengthwise direction and a breadthwise direction of the liquid ejection head.

According to this aspect of the present invention, it is possible to make efficient use of the gaps between the head modules.

Preferably, the nozzle plate is made of silicon.

According to this aspect of the present invention, the silicon nozzle plate is liable to produce cracks or defects due to stress or mechanical impacts, and these cracks or defects can be identified.

It is also preferable that the nozzle plate is made of one of metal and resin.

According to this aspect of the present invention, the nozzle plate made of metal or resin is liable to produce deformation due to stress or mechanical impacts, and this deformation can be identified.

In order to attain the aforementioned object, the present invention is also directed to a liquid ejection apparatus, comprising: a liquid ejection head including: a nozzle plate formed with a nozzle aperture through which liquid is ejected; and a flow channel plate formed with at least a flow channel connected to the nozzle aperture, the flow channel plate being bonded to the nozzle plate with the flow channel aligned to the nozzle aperture in the nozzle plate, the nozzle plate being provided with a detection element configured to detect a mechanical abnormality in the nozzle plate; and a detection device configured to detect the mechanical abnormality in the nozzle plate in accordance with information obtained from the detection element.

The liquid ejection apparatus includes an inkjet recording apparatus which ejects color inks from inkjet heads.

Preferably, a first surface of the nozzle plate is bonded with the flow channel plate; the detection element includes at least one of a first electrical wire arranged on the first surface of the nozzle plate and a second electrical wire arranged on a second surface of the nozzle plate opposite to the first surface; and the detection device includes: a measurement unit configured to measure a resistance value of the at least one of the first and second electrical wires; and a judgment unit configured to judge whether or not the mechanical abnormality has occurred in the nozzle plate in accordance with change in the resistance value of the at least one of the first and second electrical wires obtained by the measurement unit.

According to this aspect of the present invention, it is possible to detect the mechanical abnormality in a nozzle plate in accordance with change in the resistance value of the electrical wire arranged on the nozzle plate.

Preferably, the liquid ejection apparatus further comprises a storage unit configured to store measurement results of the measurement unit.

Preferably, the flow channel plate has a liquid chamber and a flow channel, the liquid chamber connecting to the nozzle aperture in the nozzle plate, the flow channel connecting to the liquid chamber; the at least one of the first and second electrical wires is arranged to intersect with the flow channel; the at least one of the first and second electrical wires has a shape formed of a broad width section and a narrow width section, the broad width section including a portion of greatest width, the narrow width section having a width less than that of the broad width section; and the narrow width section is arranged at a position corresponding to the flow channel.

Preferably, a first surface of the nozzle plate is bonded with the flow channel plate; the detection element includes an electrostrictive element arranged on at least one of the first surface of the nozzle plate and a second surface of the nozzle plate opposite to the first surface; and the detection device includes: an electrical signal acquisition unit configured to acquire an electrical signal from the electrostrictive element; and a judgment unit configured to judge whether or not the mechanical abnormality has occurred in the nozzle plate in accordance with change in the electrical signal acquired by the electrical signal acquisition unit.

Preferably, a first surface of the nozzle plate is bonded with the flow channel plate; the detection element includes a piezoelectric element arranged on one of the first surface of the nozzle plate and a second surface of the nozzle plate opposite to the first surface; and the detection device includes: an electrical signal acquisition unit configured to acquire an electrical signal from the piezoelectric element; and a judgment unit configured to judge whether or not the mechanical abnormality has occurred in the nozzle plate in accordance with change in the electrical signal acquired by the electrical signal acquisition unit.

Preferably, the detection device is configured to acquire information from the detection element and detect the mechanical abnormality in the nozzle plate, during operation of the liquid ejection head.

According to this aspect of the present invention, it is possible to detect the mechanical abnormality in the nozzle plate which has occurred during operation of the liquid ejection head.

During operation of the liquid ejection head means a state where the power supply to the liquid ejection head is switched on, and includes a state during liquid ejection in a prescribed job, during the interval between jobs (standby), during maintenance, or the like.

Preferably, the liquid ejection apparatus further comprises a reporting device configured to issue a report when the detection device detects the mechanical abnormality in the nozzle plate.

According to this aspect of the present invention, it is possible to identify that the mechanical abnormality has occurred in the nozzle plate due to a report from the reporting device.

Preferably, the detection device includes a position identification unit configured to identify a position in the nozzle plate where the mechanical abnormality has occurred.

According to this aspect of the present invention, it is further preferable that a first surface of the nozzle plate is bonded with the flow channel plate; and the detection element includes at least one of a first electrical wire arranged on the first surface of the nozzle plate and a second electrical wire arranged on a second surface of the nozzle plate opposite to the first surface.

Preferably, the liquid ejection apparatus further comprises an abnormality processing device configured to cause respective units of the liquid ejection apparatus to execute particular sequences when the detection device detects the mechanical abnormality in the nozzle plate.

According to this aspect of the present invention, secondary damage to the respective units of the liquid ejection apparatus caused by the mechanical abnormality in the nozzle plate is prevented.

In order to attain the aforementioned object, the present invention is also directed to an abnormality detection method for a liquid ejection head including: a nozzle plate formed with a nozzle aperture through which liquid is ejected; and a flow channel plate formed with at least a flow channel connected to the nozzle aperture, the flow channel plate being bonded to to the nozzle plate with the flow channel aligned to the nozzle aperture in the nozzle plate, the nozzle plate being provided with a detection element, the method comprising the step of: detecting a mechanical abnormality in the nozzle plate in accordance with information obtained from the detection element.

According to this aspect of the present invention, by detecting the mechanical abnormality, such as cracking or deformation, in the nozzle plate, it is possible to carry out necessary processing, such as halting the operation of the liquid ejection head, and damage caused by the mechanical deformation of the nozzle plate can be minimized.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

<General Composition of Inkjet Head>

Figure 1:
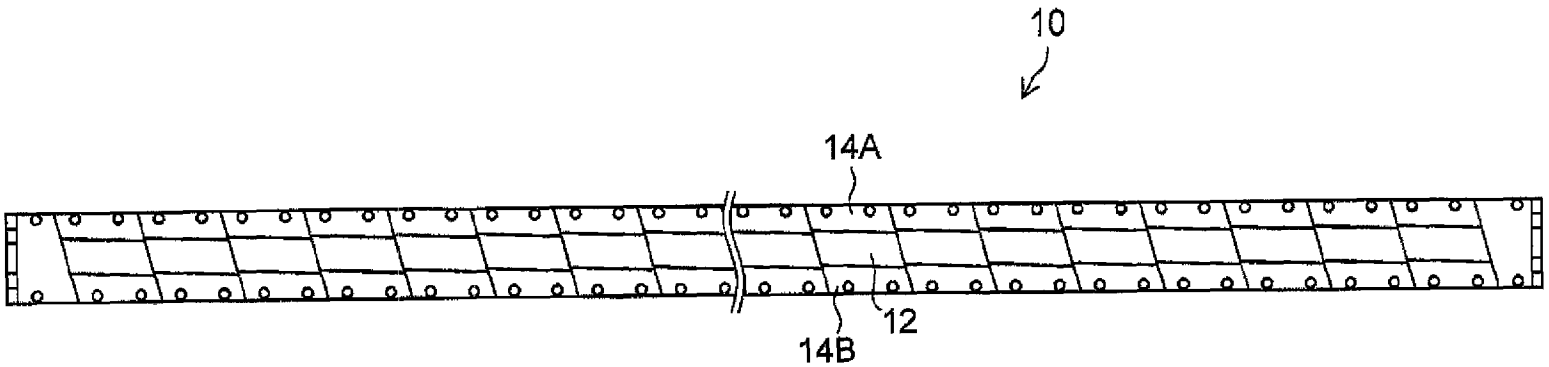
FIG. 1 is a plan diagram of a nozzle surface showing a general structure of an inkjet head according to a first embodiment of the present invention.

FIG. 1 is a plan diagram of a nozzle surface showing a general structure of a liquid ejection head or an inkjet head according to a first embodiment of the present invention. The inkjet head 10 shown in FIG. 1 is a full line-type of head, in which a plurality of nozzles 18 (shown in FIG. 2) are arranged through a length corresponding to the entire width of the region where liquid droplets are deposited on a recording medium (the entire dimension of the recording medium in the direction perpendicular to the movement direction of the recording medium).

The inkjet head 10 has a structure in which head modules 12, which are smallest compositional units, are joined together in the lengthwise direction of the inkjet head 10. Covers 14A and 14B are attached on sides of the head modules 12 in the breadthwise direction to of the inkjet head 10.

<Composition of Nozzle Plate>

Figure 2:
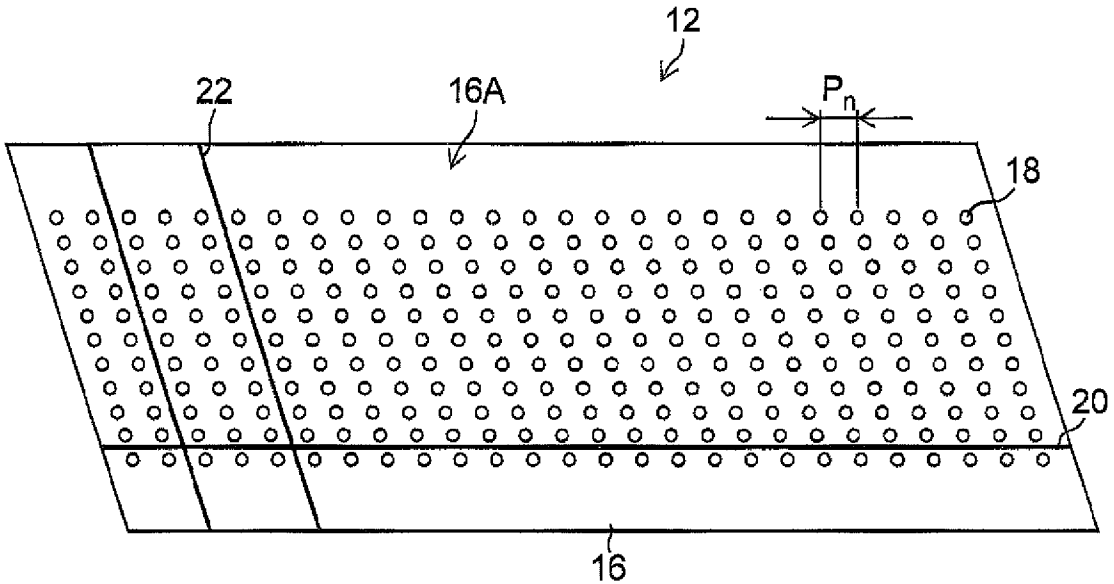
FIG. 2 is a plan diagram showing a structure of a nozzle plate of one head module in the inkjet head shown in FIG. 1.

FIG. 2 is a plan diagram showing a structure of a nozzle plate 16 in one of the head modules 12 constituting the inkjet head 10 shown in FIG. 1. The nozzle apertures 18 are arranged in a matrix configuration in the nozzle plate 16 shown in FIG. 2.

In the nozzle plate 16 shown in FIG. 2, an arrangement pitch $P_r$, between the nozzle apertures 18 in the lengthwise direction of the head module 12 (also the lengthwise direction of inkjet head 10, and the lateral direction in the drawing in FIG. 2) is in a range of 100 μm and 1 mm, and is 500 μm, for example.

The "matrix configuration" referred to here is a mode where the nozzle apertures 18 are arranged along a row direction parallel to the lengthwise direction of the inkjet head 10 and a column direction oblique to the row direction, and when the nozzle apertures 18 are projected to an alignment in the lengthwise direction of the inkjet head 10, all of the nozzle apertures 18 are arranged in a uniform pitch in the lengthwise direction of the inkjet head 10.

By arranging the nozzle apertures 18 in the matrix configuration as shown in FIG. 2, the effective arrangement density of the nozzle apertures 18 in the lengthwise direction of the inkjet head 10 is rendered high. For example, when the number of nozzle apertures 18 per column is m, the effective arrangement pitch P between the nozzle apertures 18 in the lengthwise direction of the inkjet head 10 is expressed as:

$$P=P_n/(m-1).$$

In the inkjet head 10 having the structure in which the head modules 12 are joined together, although it is possible that the arrangement pitch of the nozzle apertures 18 varies in the vicinities of the respective end sections of each head module 12 in the above-described projected row of the nozzle apertures, the arrangement pitch of the nozzle apertures 18 is uniform when the nozzle apertures 18 of the adjacent head modules 12 are regarded as interpolating with each other.

The nozzle plate 16 can be made of silicon, resin, metal, or the like. The nozzle plate 16 has electrical wires 20 and 22 arranged in an ink ejection surface 16A, and the electrical wires 20 and 22 are used for detecting mechanical abnormalities of the nozzle plate 16, such as cracking or deformation (hereinafter also referred to simply as "cracking", "abnormalities" or "mechanical abnormalities").

In FIG. 2, the detection wire 20 is arranged along a direction substantially parallel to the column direction of the nozzle apertures 18, and the detection wires 22 are arranged along a direction substantially parallel to the row direction of the nozzle apertures 18. Here, the arrangement direction of the detection wire is defined as the direction along the straight line that links both ends of the detection wire.

The detection wires 20 and 22 are electrically connected to extraction terminals or electrodes 92 (shown in FIGS. 11A to 12B) arranged on the end sections of the nozzle plate 16, and are electrically connected to a resistance measurement circuit 293 (shown in FIG. 16) in the inkjet head 10, as described in detail below.

According to the inkjet head 10 in the present embodiment, it is possible to detect a mechanical abnormality, such as cracking or deformation, of the nozzle plate 16 on the basis of change in the electrical resistance of each of the detection wires 20 and 22. For example, if cracking or deformation has occurred in the nozzle plate 16, then deformation or severance occurs in one or more of the detection wires 20 and 22 passing through the portion where the cracking or deformation has occurred, and the electrical resistance of the detection wire changes (increases).

By monitoring the resistance values of the detection wires 20 and 22 and comparing with the resistance values of the detection wires 20 and 22 in a normal state, it is judged whether or not cracking or deformation has occurred in the nozzle plate 16 on the basis of change in the resistance values of the detection wires 20 and 22.

According to the composition in which the plurality of detection wires 20 and 22 are arranged and the arrangement directions of the detection wires 20 and 22 intersect each other as shown in FIG. 2, it is possible to detect cracking or deformation over the whole range of the nozzle plate 16, and it is further possible to identify the position of the cracking or deformation, as described in detail below.

The number of detection wires 20 and 22 and the positions in which the detection wires 20 and 22 are arranged are not limited to the mode shown in FIG. 2, in which the one detection wire 20 is arranged in the row direction, and the two detection wires 22 are arranged in the column direction.

Moreover, the detection wire 20 can be of a length that does not reach both ends of the nozzle plate 16 in the lengthwise direction thereof, and the detection wires 22 can be of a length that does not reach both ends of the nozzle plate 16 in the breadthwise direction thereof, although FIG. 2 shows the mode in which the detection wire 20 has the length that reaches to both ends of the nozzle plate 16 in the lengthwise direction thereof, and the detection wires 22 have the length which reaches both ends of the nozzle plate 16 in the breadthwise direction thereof.

The detection wires 20 and 22 can be made of a metal such as gold (Au), copper (Cu), nickel (Ni), aluminum (Al) or an alloy of these. The widths of the detection wires 20 and 22 can be approximately 50 μm, for example, and can be appropriately designed in accordance with the pitch between the nozzle apertures 18.

The thicknesses of the detection wires 20 and 22 can be approximately 0.1 μm, for example, and can be appropriately designed in accordance with the required resistance values of the detection wires 20 and 22. The lengths of the detection wires 20 and 22 can be approximately several centimeters (cm), and can be appropriately designed in accordance with the size of the nozzle plate 16 and the required resistance values of the detection wires 20 and 22.

The resistance value R (Ω) of the detection wire is expressed as:

$$R=\rho \cdot L/A,$$

where ρ (Ω·m) is the electrical resistivity of the material of the detection wire, L (m) is the length of the detection wire, and A ($m^2$) is the sectional area of the detection wire.

The electrical resistivities of copper and gold are respectively $1.68\times10^{-8}$ Ω·m and $2.21\times10^{-8}$ Ω·m. By using a material having a higher electrical resistivity, it is possible to improve the detection sensitivity of the resistance value.

<Compositions of Detection Wires>

Figure 3A:
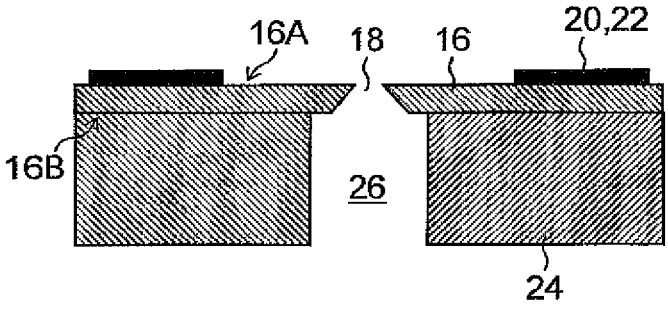
FIGS. 3A and 3B are cross-sectional diagrams showing the inner structures around nozzles in the inkjet heads.
Figure 3B:
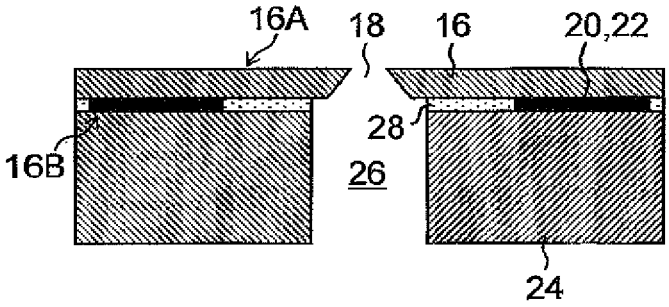

FIGS. 3A and 3B are cross-sectional diagrams showing the inner structures around the nozzles in embodiments of the inkjet head shown in FIG. 1, in which the ink ejection direction is shown upward. As shown in FIGS. 3A and 3B, the nozzle apertures 18 in the nozzle plate 16 and the nozzles (nozzle flow channels) 26 formed in a flow channel plate 24 are aligned, whereupon the flow channel plate 24 is bonded to the surface 16B of the nozzle plate 16 on the opposite side to the ink ejection surface 16A.

In FIGS. 3A and 3B, the liquid chambers connecting to the nozzles 26, and the like (see FIGS. 14A and 14B) are not shown. It is also possible to adopt a mode in which the nozzles 26 are omitted and the nozzle apertures 18 and the flow channels in the flow channel plate 24 are aligned, whereupon the nozzle plate 16 and the flow channel plate 24 are bonded together.

Here, the "flow channels" in the flow channel plate 24 include pressure chambers (liquid chambers) and the nozzles (nozzle flow channels) 26.

In the mode shown in FIG. 3A, the detection wires 20 and 22 are arranged on the ink ejection surface 16A. On the other hand, in the mode shown in FIG. 3B, the detection wires 20 and 22 are arranged on the surface 16B of the nozzle plate 16 opposite to the ink ejection surface 16A (the surface that is bonded to the flow channel plate 24).

In the mode shown in FIG. 3B, the detection wires 20 and 22 are buried in adhesive 28, with which the nozzle plate 16 is bonded to the flow channel plate 24.

Figure 4:
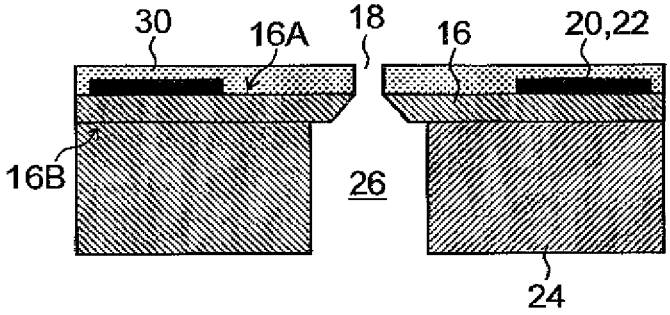
FIG. 4 is a cross-sectional diagram showing the inner structure of another mode of the inkjet head.

FIG. 4 is a cross-sectional diagram showing the inner structure of another mode of the inkjet heads shown in FIGS. 3A and 3B, in which the detection wires 20 and 22 arranged on the ink ejection surface 16A are covered with an insulating layer 30 (first insulating layer). In FIG. 4 also, the ink ejection direction is shown upward.

The ink ejected from the nozzle apertures 18 can adhere to the ink ejection surface 16A. In this event, if the detection wires 20 and 22 are arranged on the ink ejection surface 16A, then by covering the detection wires 20 and 22 with the insulating layer 30, electrical insulating properties between the detection wires 20 and 22 and the other members is guaranteed, as well as preventing corrosion of the detection wires 20 and 22 and the nozzle plate 16 caused by the adhering ink.

A liquid repellent treatment is applied to the ink ejection surface 16A with the object of preventing the wetting and spreading of the adhering ink. In the mode where the detection wires 20 and 22 are covered with the insulating layer 30, a liquid repellent film (not shown) is arranged over the insulating layer 30.

Figure 5A:
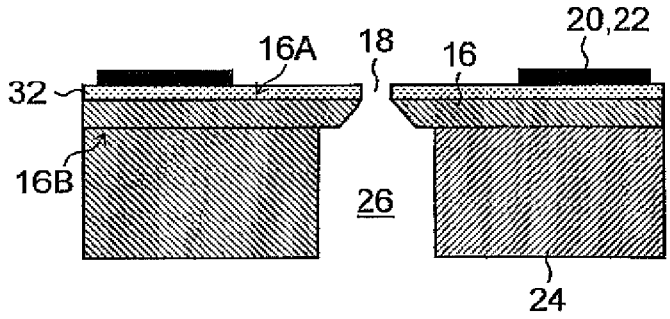
FIGS. 5A and 5B are cross-sectional diagrams showing the inner structures of further modes of the inkjet heads.
Figure 5B:
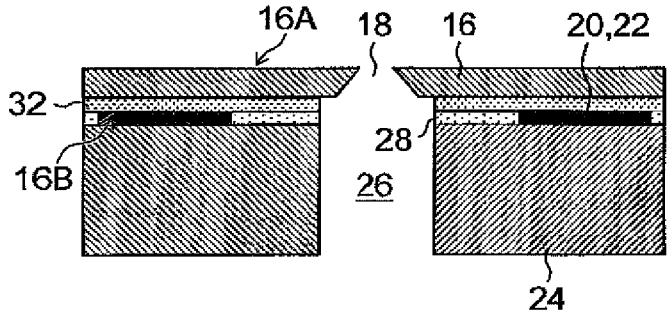

FIGS. 5A and 5B are cross-sectional diagrams showing the inner structures of further modes of the inkjet heads shown in FIGS. 3A and 3B, in which an insulating layer 32 (second insulating layer) is arranged between the nozzle plate 16 and the detection wires 20 and 22. In FIGS. 5A and 5B also, the ink ejection direction is shown upward.

More specifically, when the nozzle plate 16 is made of a material having conductivity (e.g., metal) such as stainless steel, in order to guarantee electrical insulating characteristics between the nozzle plate 16 and the detection wires 20 and 22, the insulating layer 32 is arranged between the nozzle plate 16 and the detection wires 20 and 22.

An example of the insulating layer 32 is a film made of $SiO_2$ having a thickness in a range of 0.1 μm to 1 μm. The insulating resistance of this film is in a range of several to kiloohms (kΩ) to several megaohms (MΩ). The insulating resistance varies with the properties of the film, and so on.

A further example of the insulating layer 32 is a film made of an epoxy resin material made of SU8, for instance. If SU8 is used for the insulating layer 32, then the thickness is set in a range of 1 μm to 5 μm. The volume resistivity of SU8 is $1.8\times10^{16}$ Ω·cm, and the thickness of the film is designed in accordance with the required insulating properties.

In the inkjet head 10 which is composed as described above, since the detection wires 20 and 22 are arranged as elements for detecting cracking or deformation on the nozzle plate 16, then the mechanical abnormality such as cracking or deformation in the nozzle plate 16 can be detected on the basis of the resistance values of the detection wires 20 and 22, thus making it possible to carry out required processing, such as halting operation of the liquid ejection head, and minimizing damage caused by the mechanical abnormality of the nozzle plate.

Figure 13A:
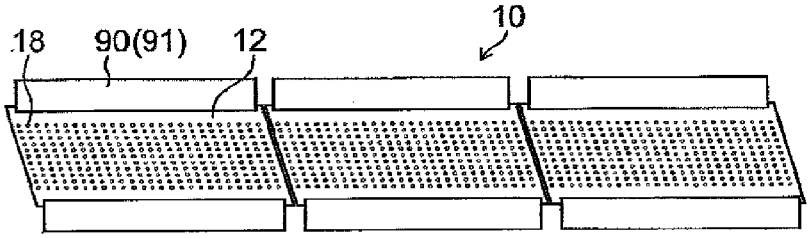
FIGS. 13A and 13B are illustrative diagrams showing schematic views of directions of extracting the extraction wires (or FPC boards)
Figure 13B:
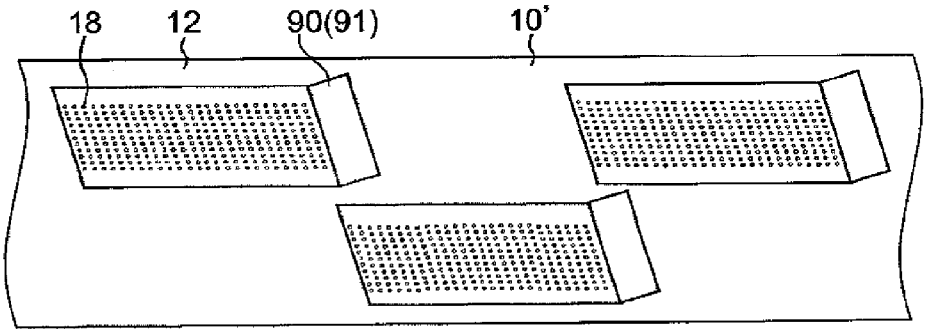

The present embodiment describes the full line-type of inkjet head 10 using the mode in which the head modules 12 are joined together in one row along the lengthwise direction of the inkjet head 10, but it is also possible to employ a mode in which the head modules 12 are aligned in a two-row staggered configuration (see FIG. 13B). Furthermore, it is also possible to use a full line-type of head that has an integrated structure (namely, which is equipped with a single long head module 12).

In the present embodiment, the mode is described in which the nozzle apertures 18 are arranged in the matrix configuration, but it is also possible to adopt a mode in which the nozzle apertures 18 are arranged in one row along the lengthwise direction of the inkjet head 10, or a mode in which the nozzle apertures 18 are arranged in a two-row staggered configuration.

Second Embodiment

Next, an inkjet head 40 according to a second embodiment of the present invention is described. In the structure of the inkjet head 40 in the second embodiment described below, the portions which are common to the inkjet head 10 in the first embodiment are not explained again here, and only the different portions are described.

Figure 6A:
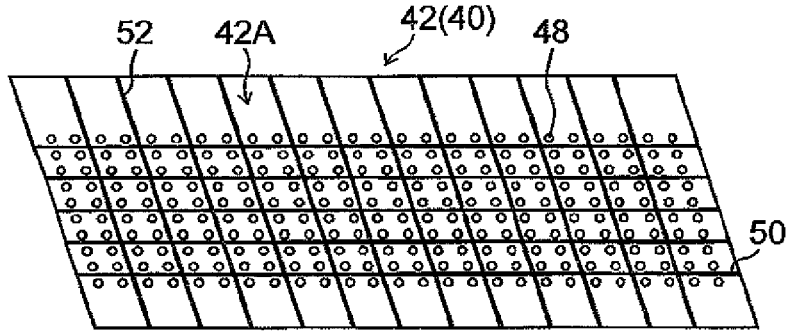
FIG. 6A is a plan diagram of an ink ejection surface of an inkjet head according to a second embodiment of the present invention.
Figure 6B:
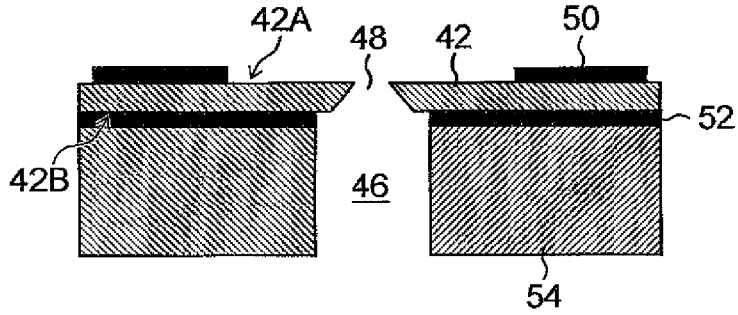
FIG. 6B is a cross-sectional diagram showing the inner structure around a nozzle in the inkjet head in FIG. 6A.

FIG. 6A is a plan diagram of an ink ejection surface 42A of a nozzle plate 42 of the inkjet head 40 in the second embodiment of the present invention, and FIG. 6B is a cross-sectional diagram showing the inner structure around a nozzle 46 in the inkjet head 40. In FIG. 6B also, the ink ejection direction is shown upward.

In the nozzle plate 42 shown in FIG. 6A, a plurality of nozzle apertures 48 are arranged in a matrix configuration, and detection wires 50 and 52 are arranged so as to correspond to the arrangement of the nozzle apertures 48.

More specifically, the detection wires 50 are arranged along the directions substantially parallel to the lengthwise direction of the nozzle plate 42 (the row direction in the matrix arrangement of the nozzle apertures 48), and the detection wires 50 are arranged separately from each other in the breadthwise direction of the nozzle plate 42. The detection wires 52 are arranged along the directions substantially parallel to the oblique direction (the column direction in the matrix arrangement of the nozzle apertures 48), which is oblique to the lengthwise direction and the breadthwise direction of the nozzle plate 42, and the detection wires 52 are arranged separately from each other in the lengthwise direction of the nozzle plate 42.

By arranging the detection wires 50 and 52 in the two mutually intersecting directions and arranging the plurality of detection wires 50 and the plurality of detection wires 52 (i.e., by arranging the detection wires 50 and 52 in a mesh shape) as shown in FIG. 6A, it is possible to identify a position of crack or deformation in the nozzle plate 42.

As shown in FIG. 6B, by arranging the detection wires 50 in the row direction on the ink ejection surface 42A and arranging the detection wires 52 in the column direction on the opposite surface 42B to the ink ejection surface 42A (the surface on the side of the flow channel plate 54), it is possible to measure the resistance values of the detection wires 50 and 52 independently. Of course, it is possible that the detection wires 50 in the row direction are arranged on the opposite surface 42B to the ink ejection surface 42A, and the detection wires 52 in the column direction are arranged on the ink ejection surface 42A.

For example, if the resistance value of the second detection wire 50 from the top side in FIG. 6A is different from the standard value and the resistance value of the second detection wire 52 from the left-hand side in FIG. 6A is different from the standard value, then it can be judged that a crack has occurred in the vicinity of the position of the intersection between these detection wires.

In the mode shown in FIG. 6A, the detection wires 50 are arranged every other nozzle row and the detection wires 52 are arranged every other nozzle column. Of course, it is also possible to make the arrangement densities of the detection wires 50 and 52 denser or sparser.

Although not shown in FIG. 6B, the insulating layer 30 shown in FIG. 4 and the insulating layer 32 shown in FIGS. 5A and 5B can be formed appropriately. Furthermore, it is also possible to arrange the detection wires 50 and 52 having a shape other than the linear shape, such as a curved shape, or the like. Taking account of this mode, the arrangement direction of the detection wire is the direction represented by the line linking both ends of the detection wire.

According to the inkjet head 40 in the second embodiment, by arranging the detection wires 50 and 52 for detecting cracking or deformation in the nozzle plate 42 in mutually intersecting directions, as well as arranging the plurality of detection wires 50 and the plurality of detection wires 52, it is possible to identify a position in the nozzle plate 42 where cracking or deformation has occurred.

For example, if nozzles corresponding to inks of a plurality of colors are arranged in one head, then since separate (independent) flow channels are arranged for each color, it is possible to halt the ink supply in the flow channels corresponding to the position of the detected crack (or deformation) in the nozzle plate 42, and damage caused by cracking or deformation of the nozzle plate 42 can be minimized.

In the present embodiment, the mode is described in which the detection wires 50 are arranged in the row direction and the detection wires 52 are arranged in the column direction, of the arrangement of the nozzle apertures 48, but it is sufficient for the detection wires 50 and 52 to be arranged in directions which mutually intersect (non-parallel directions), and if the shape of the nozzle plate 42 and the positions liable to crack are identified in advance, then the arrangement directions of the detection wires 50 and 52 can be appropriately designed in accordance with the positions where cracking is liable to occur, or the like.

Furthermore, the arrangement directions of the detection wires are not limited to two directions, and the detection wires can be arranged along three or more mutually intersecting directions.

Third Embodiment

Next, an inkjet head 60 according to a third embodiment of the present invention is described. In the structure of the inkjet head 60 in the third embodiment described below, the portions which are common to the inkjet heads 10 and 40 in the first and second embodiments are not explained again here, and only the different portions are described.

Figure 7A:
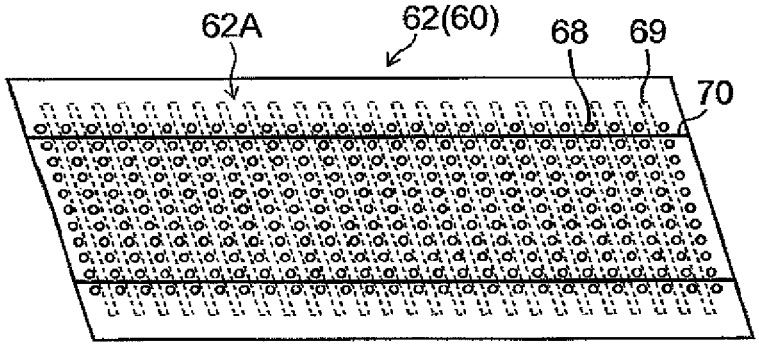
FIG. 7A is a plan diagram of an ink ejection surface of an inkjet head according to a third embodiment of the present invention.
Figure 7B:
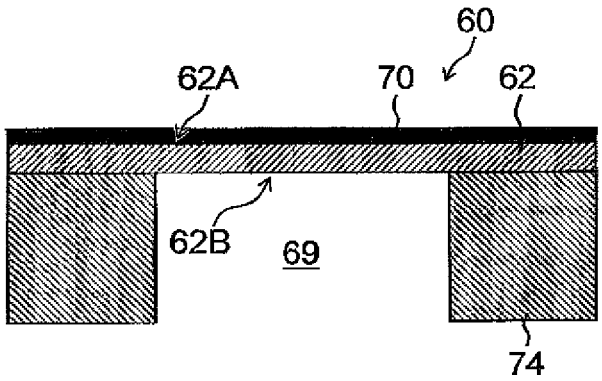
FIG. 7B is a cross-sectional diagram along a detection wire in FIG. 7A.

FIG. 7A is a plan diagram of an ink ejection surface 62A of a nozzle plate 62 of the inkjet head 60 in the third embodiment of the present invention, and FIG. 7B is a cross-sectional diagram along a detection wire 70 shown in FIG. 7A. Only one of common flow channels 69 is shown in FIG. 7B.

The inkjet head 60 shown in FIG. 7A has the common flow channels 69 (depicted with dashed lines) arranged along the column direction of the arrangement of nozzle apertures 68, and the common flow channels 69 are arranged separately from each other in the row direction in the arrangement of the nozzle apertures 68.

The common flow channels 69 are connected to an upstream side ink flow channel (not shown), and the upstream side ink flow channel is connected through an ink supply port to an external ink flow channel (not shown) of the inkjet head 60 and an ink tank (not shown).

One common flow channel 69 is connected to all of the pressure chambers which are connected to the nozzle apertures 68 belonging to the same column (the pressure chambers are not shown in FIGS. 7A and 7B and are denoted with the reference numeral 27 in FIG. 14A and the reference numeral 27' in FIG. 14B), and the ink supplied from the ink tank (not shown) is supplied through the common flow channels 69 to the pressure chambers which are connected to the respective common flow channels 69.

The detection wires 70 on the nozzle plate 62 are arranged along the direction that intersects with the direction in which the common flow channels 69 are arranged, so as to span at least one common flow channel 69.

If the material of the nozzle plate 62 is silicon, then in cases where there are common flow channels 69 in the surface (rear surface) 62B on the opposite side to the ink ejection surface 62A of the nozzle plate 62, the positions of the common flow channels 69 are liable to crack, and therefore, by arranging the detection wires 70 so as to span the common flow channels 69, it is possible to improve the probability of detecting the nozzle plate 62 cracking.

Shape of Detection Wires

<Planar Shape>

Next, the shapes of the detection wires are explained in more detail. FIGS. 8A to 8D are illustrative diagrams showing embodiments of the planar shapes of the detection wires. In the description given below, the detection wires 20 and 22 in FIG. 2, the detection wires 50 and 52 in FIG. 6 and the detection wires 70 in FIG. 7, which have been described above, are described jointly as detection wires 80 to 86.

Figure 8A:
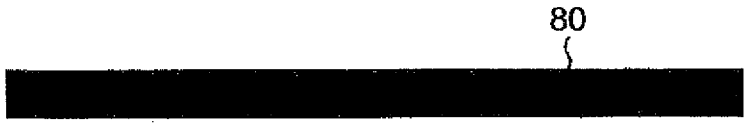
FIGS. 8A to 8D are illustrative diagrams showing planar shapes of detection wires.

The detection wire 80 shown in FIG. 8A has a substantially linear shape of uniform width and has a substantially rectangular planar shape. The substantially linear detection wire 80 is easy to form and a stable resistance value can be obtained. Also possible is a mode which includes a curved shape.

Figure 8B:
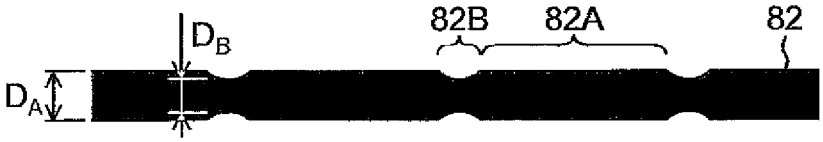

The detection wire 82 shown in FIG. 8B has broad width sections 82A having a uniform width and narrow width sections 82B having a width shorter than that of the broad width sections 82A. The narrow width sections 82B shown in FIG. 8B have a shape in which the broad width sections 82A are cut out in a substantially circular arc shape on each side.

Figure 8C:
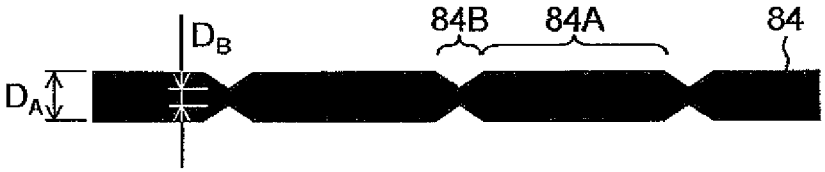

The detection wire 84 shown in FIG. 8C is the same as the detection wire 82 shown in FIG. 8B in having broad width sections 84A having a uniform width and narrow width sections 84B having a width shorter than that of the broad width sections 84A. The narrow width sections 84B of the detection wire 84 shown in FIG. 8C have a shape in which the broad width sections 84A are cut out in a substantially triangular shape on each side.

Figure 8D:
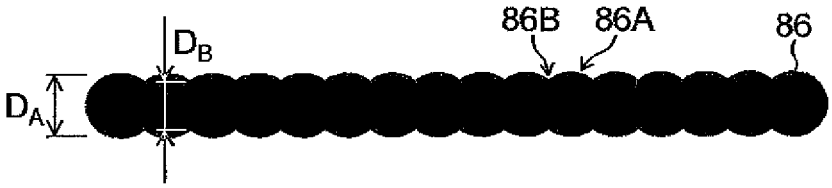

The detection wire 86 shown in FIG. 8D has a planar shape in which a plurality of substantially circular shapes are joined together in one row so as to be partially overlapping each other. The broad width sections 86A of the detection wire 86 are in the regions of the positions of the greatest width of the detection wire 86 and the narrow width sections 86B are in the regions of the positions of the narrowest width.

The detection wire 86 shown in FIG. 8D can be formed easily by an inkjet method using a functional liquid containing metal particles. By adjusting the dot size (diameter) and the dot pitch (the distance between the centers of adjacent dots), it is possible readily to adjust the maximum width of the broad width sections 86A and the minimum width of the narrow width sections 86B.

For instance, the maximum width of the broad width sections 86A can be raised by increasing the diameter of the dots. If the dot pitch is raised, then the minimum width of the narrow width sections 86B becomes smaller, and if the dot pitch is reduced, then the minimum width of the narrow width sections 86B becomes larger.

In the detection wires 82, 84 and 86 shown in FIGS. 8B, 8C and 8D, the relationship between the maximum widths $D_A$ of the broad width sections 82A, 84A and 86A and the minimum widths $D_B$ of the narrow width sections 82B, 84B and 86B is $D_A>D_B$.

The smaller the minimum widths $D_B$ of the narrow width sections 82B, 84B and 86B compared to the maximum widths $D_A$ of the broad width sections 82A, 84A and 86A, the more liable severance is to occur, and hence the higher the beneficial effects (detection sensitivity). On the other hand, if the minimum widths $D_B$ of the narrow width sections 82B, 84B and 86B are made smaller, then the resistance values of the detection wires 82, 84 and 86 become higher and therefore the narrow width sections 82B, 84B and 86B have to be made thicker in such a manner that the resistance values come within a suitable range.

However, if the minimum widths $D_B$ of the narrow width sections 82B, 84B and 86B are too small, then there is a possibility of severance during manufacture, due to manufacturing variations. If the detection wires 82, 84 and 86 are formed by means of the inkjet method, then there is a risk that the dots cannot link together to form lines, due to variation in the ejected droplet volumes (variation in the dot sizes), or variation in the ejection directions (variation in the dot positions).

Hence, the minimum width $D_B$ of the narrow width sections 82B, 84B and 86B cannot be made extremely small, and it is therefore preferable that the broad width sections 82A, 84A and 86A and the narrow width sections 82B, 84B and 86B are formed in such a manner that $D_A$ and $D_B$ satisfy the following relationship:

$$0.8\times D_A>D_B>0.5\times D_A.$$

The narrow width sections 82B, 84B and 86B which have the narrower widths than the other sections are more liable to produce severance or deformation, and therefore it is possible to improve the detection sensitivity in relation to cracking or deformation of the nozzle plates. The narrow width sections 82B, 84B and 86B can be arranged in one place or in a plurality of places in each detection wire. If the positions where cracking or deformation is liable to occur are identified in advance, it is then preferable that the narrow width sections 82B, 84B and 86B are formed in the positions where cracking or deformation is liable to occur.

Examples of the positions for forming the narrow width sections 82B, 84B and 86B are the positions of the common flow channels 69 shown in FIGS. 7A and 7B.

<Thickness>

Next, the thickness of the detection wire 80 (or 82, 84 or 86) is described in detail. In a mode including the plurality of detection wires 80, it is desirable that the resistance values of the detection wires 80 are uniform. On the other hand, the resistance values of the detection wires 80 can give rise to fluctuations of around several percent (%).

The variation (error) in the resistance values of the detection wires 80 affects the detection accuracy, and therefore it is desirable to restrict the variation of the resistance values as much as possible. Consequently, the resistance values of the detection wires 80 arranged in the same nozzle plate are measured, and if there is a wire having the resistance value out of the prescribed range of variation, the resistance value thereof can be brought within the prescribed range of variation by adjusting the thickness of the wire.

For example, if there is a wire having the resistance value exceeding the prescribed range, then the thickness of the wire is increased by a plating process, or the like. On the other hand, if there is a wire having the resistance value below the prescribed range, then the thickness of the wire is reduced by polishing, or the like. It is also possible to adjust the resistance value by the shape and/or number of narrow width sections 82B, 84B and 86B.

Procedure for Forming Detection Wires

Figure 9:
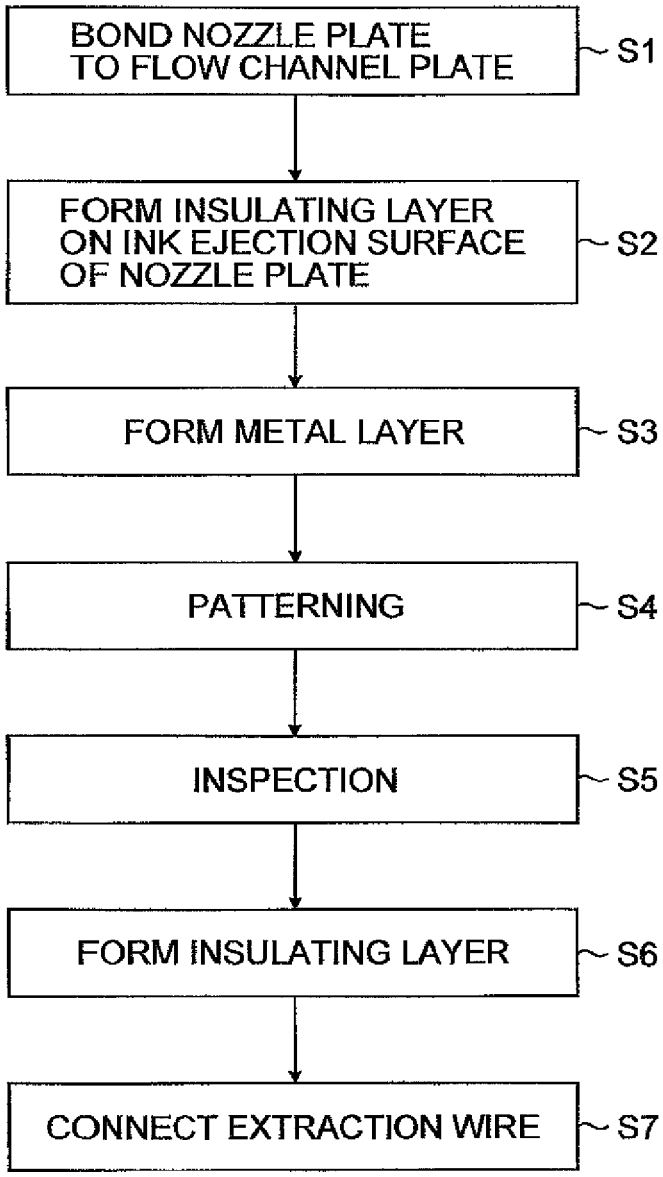
FIG. 9 is a flowchart showing a procedure for forming the detection wire.
Figure 10:
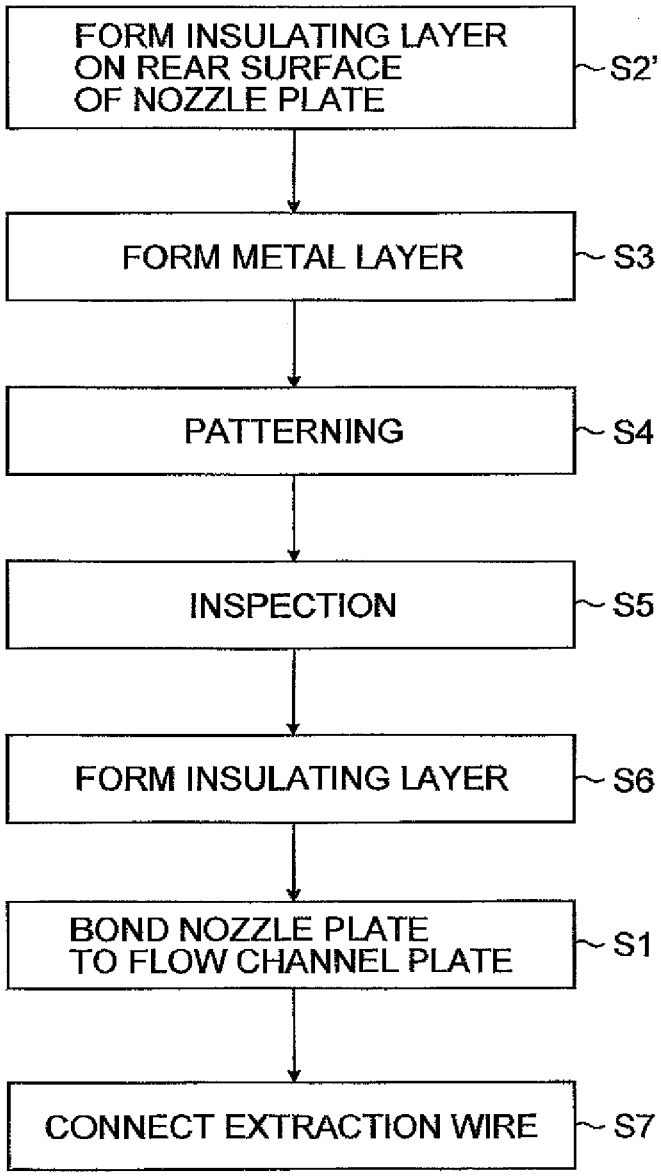
FIG. 10 is a flowchart showing another procedure for forming the detection wire.

FIGS. 9 and 10 are flowcharts showing procedures for forming the detection wires. FIG. 9 shows the procedure for forming the detection wires 20 and 22 after bonding the nozzle plate 16 to the flow channel plate 24.

As shown in FIG. 9, the flow channel plate 24 is bonded to the nozzle plate 16 (see FIG. 3A) (step S1), and the insulating layer 32 (see FIG. 5A) is then formed on the ink ejection surface 16A of the nozzle plate 16 (step S2). The insulating layer 32 can be made of $SiO_2$, for example. If the nozzle plate 16 is not a metal material, then the step S2 can be omitted.

Next, a metal layer that is to form the detection wires 20 and 22 is formed on the insulating layer 32 (or on the ink ejection surface 16A if the insulating layer 32 is not formed) (step S3). For the method of forming the metal layer, a thin film deposition technique (sol gelation, sputtering, or the like) is used.

When the metal layer has been formed, the metal layer is subjected to patterning (step S4). The patterning of the metal layer can include: a step of applying photoresist onto the whole surface of the metal layer; a step of patterning the photoresist by exposing and developing the photoresist; and an etching step in which an etching process is carried out using the patterned resist as a mask.

If the nozzle apertures 18 have already been made, then it is difficult to employ a wet process and it is therefore preferable to use a dry film resist.

When the metal film patterning step (step S4) has been carried out and the detection wires 20 and 22 have been formed, the resistance values of the detection wires 20 and 22 are measured (step S5, inspection step). In the inspection step, when the resistance values of the detection wires 20 and 22 exceed the standard range, the detection wires 20 and 22 are grown by a plating process to increase the thickness, in such a manner that the resistance values of the detection wires 20 and 22 come within the standard range.

Subsequently, the detection wires 20 and 22 are covered with the insulating layer 30 (see FIG. 4) (step S6), and extraction wires are connected (step S7). It is also possible to integrate the metal layer forming step (step S3) and the patterning step (step S4), and the detection wires 20 and 22 can be formed by the inkjet method.

In forming the detection wires 20 and 22 by the inkjet method, it is possible to obtain a desired thickness of the detection wires 20 and 22 by a plurality of superimposed deposition actions of the material droplets (lamination of patterns). Furthermore, it is also possible to employ superimposed deposition actions by the inkjet method to adjust the resistance values in the inspection step (step S5).

It is also possible to employ a lift-off method as another forming method for the detection wires 20 and 22. In the lift-off method, photoresist is applied after forming the insulating layer, the photoresist is patterned, the metal film is then deposited and the photoresist is removed, at the same time as which the metal film on the photoresist is removed, thereby forming the detection wires 20 and 22.

FIG. 10 shows the procedure in a case where the detection wires 20 and 22 are formed in the individual nozzle plate 16, before the nozzle plate 16 is bonded to the flow channel plate 24. FIG. 10 shows a case where the detection wires 20 and 22 are formed in the rear surface 16B of the nozzle plate 16 (the surface on the opposite side from the ink ejection surface 16A), and if the detection wires 20 and 22 are formed on the ink ejection surface 16A, then reference to the "rear surface 16B" in FIG. 10 should be read as the "ink ejection surface 16A". In FIG. 10, the steps which are the same as the steps described with reference to FIG. 9 are denoted with the same reference numerals, and description thereof is omitted here.

In the forming procedure of the detection wires 20 and 22 shown in FIG. 10, the nozzle plate 16 having the detection wires 20 and 22 formed on the rear surface 16B thereof is manufactured by forming the insulating layer 32 on the rear surface 16B of the nozzle plate 16 (see FIG. 5A) (step S2'), and subsequently carrying out the metal layer forming step (step S3), the patterning step (step S4), the inspection step (step S5), and the insulating layer forming step (step S6).

Next, the flow channel plate 24 is bonded to the nozzle plate 16 on which the detection wires 20 and 22 have been formed (the nozzle plate bonding step, step S1), and the extraction wires are bonded thereto (the extraction wiring step, step S7).

It is also possible to exchange the nozzle plate bonding step (step S1) and the extraction wire bonding step (step S74), in such a manner that the nozzle plate 16 to which the extraction wires have been bonded is then bonded to the flow channel plate 24.

If the detection wires 20 and 22 are formed on the nozzle plate 16 before bonding the nozzle plate 16 and the flow channel plate 24, then the photoresist, and the like, never enters into the internal flow channels of the inkjet head, and the like, and hence the detection wires 20 and 22 can be formed readily by means of a wet process.

Although not shown in FIGS. 9 and 10, the procedures can include a step of forming the liquid repellent film (a liquid repellent film forming step) on the ink ejection surface 16A. The procedure shown in FIG. 9 is employed, if the processing temperature in the nozzle plate bonding step exceeds the heat resistance temperature of the detection wires 20 and 22.

Compositions of Extraction Wires

Figure 11A:
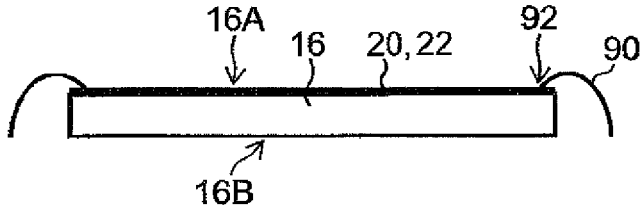
FIGS. 11A to 11C are illustrative diagrams showing a procedure for forming an extraction wire extracted from the detection wire.
Figure 11B:
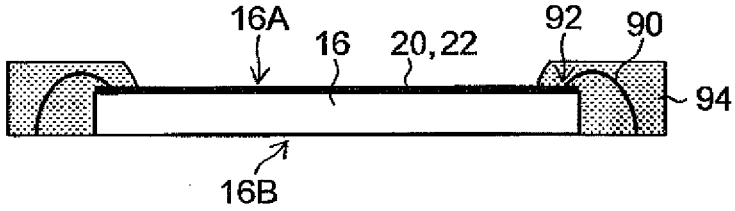
Figure 11C:
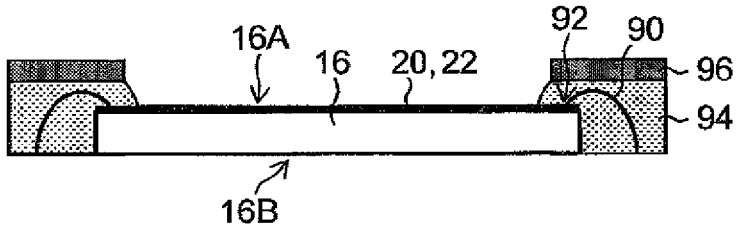

Next, the extraction wires extracted from the detection wires are described. FIGS. 11A to 11C are illustrative diagrams showing a forming procedure for extraction wires 90 which are extracted from the detection wires 20 and 22, in which the extraction wires 90 are arranged by wire bonding.

As shown in FIG. 11A, extraction electrodes 92 are formed at either end portion of the detection wires 20 and 22 which are formed on the ink ejection surface 16A of the nozzle plate 16 (or the rear surface 16B). The extraction electrodes 92 are formed in either end portion of the nozzle plate 16. Next, the extraction electrodes 92 and the extraction wires 90 are electrically bonded. Soldering or conductive adhesive can be employed for this bonding.

Moreover, it is also possible to adopt a mode in which a connector (for example, a receptacle) is installed instead of the extraction electrodes 92, a corresponding connector (for example, a plug) is attached at the extraction electrode side, and by fitting these connectors together, the detection wires 20 and 22 and the extraction wires 90 are connected.

The insulating layer 30 shown in FIG. 4 and the liquid repellent film (not shown) are not formed on the portion where the extraction electrodes 92 are formed.

When the extraction wires 90 and the extraction electrodes 92 are bonded together as shown in FIG. 11B, the vicinities of the bonding portions (extraction electrodes 92) are coated with coating members 94 made of silicone resin, epoxy resin, or the like, and the coating members 94 are cured by heating.

Then, as shown in FIG. 11C, covers 96 made of metal (or a resin such as epoxy resin) are attached over the coating members 94. By attaching the covers 96 shown in FIG. 11C, abrasion, rupture and detachment of the coating members 94 during wiping of the ink ejection surface 16A are prevented.

Figure 12A:
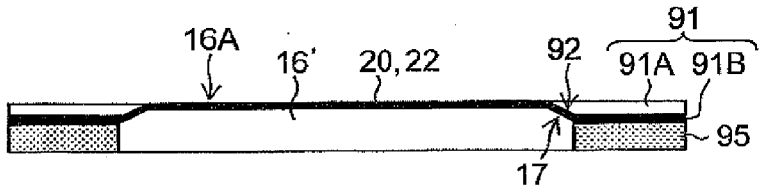
FIGS. 12A and 12B are illustrative diagrams showing another procedure for forming the extraction wire.
Figure 12B:
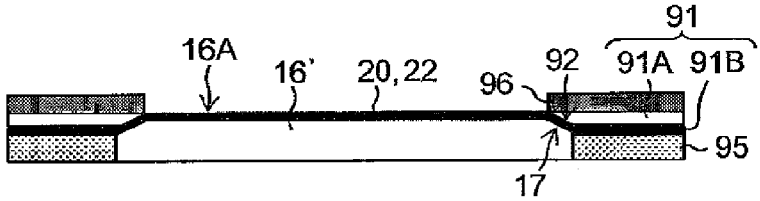

FIGS. 12A and 12B are illustrative diagrams showing another mode of the forming procedure for the extraction wires shown in FIGS. 11A to 11C, and a flexible printed circuit (FPC) board 91 is employed for the extraction wires. The FPC board 91 has a structure in which a wiring pattern (wiring layer) 91B is formed on a base material (resin layer) 91A, and the wiring pattern 91B is covered with an insulating layer (not shown).

In the nozzle plate 16' shown in FIG. 12A, an inclined section 17 having a chamfered edge (diagonally cut end) is formed and the extraction electrodes 92 are formed on the inclined surface of the inclined section 17. The end portion of the FPC board 91 adopts an inclined shape corresponding to the inclined section 17 of the nozzle plate 16', and the end portions of the wiring pattern 91B are exposed in the inclined end of the FPC board 91.

The inclined end of the FPC board 91 is fitted together with the inclined section 17 of the nozzle plate 16', the extraction electrodes 92 on the nozzle plate 16' and the wiring pattern 91B on the FPC board 91 are aligned, and the FPC board 91 is bonded to the nozzle plate 16'. The rear surface of the FPC board 91 (the surface that is not exposed on the side of the ink ejection surface 16A) is supported by a supporting member 95 made of resin, for example.

According to the mode shown in FIG. 12A, the FPC board 91 never projects beyond the ink ejection surface 16A' of the nozzle plate 16' in a state where the FPC board 91 is bonded to the nozzle plate 16'.

Moreover, by installing the cover 96 protecting the FPC board 91 as shown in FIG. 12B, abrasion, rupture and detachment of the FPC board 91 during wiping of the ink ejection surface 16A are prevented.

FIGS. 13A and 13B are schematic drawings of the directions of extension of the extraction wires 90 and the FPC boards 91. FIG. 13A shows the direction of extension of the extraction wires 90 (or the FPC boards 91) in the inkjet head 10 in which the head modules 12 are joined together in one row. In the inkjet head 10 shown in FIG. 13A, the gaps between mutually adjacent head modules 12 are several hundred micrometers (μm), and the extraction wires 90 (or the FPC boards 91) cannot be extracted through these gaps. Consequently, the extraction wires 90 (or the FPC boards 91) are extracted from either end of each head module 12 in the breadthwise direction of each head module 12 (or the inkjet head 10). According to this mode, it is possible to bond the extraction wires 90 (or the FPC boards 91) without applying mechanical stress to the extraction wires 90 (or the FPC boards 91).

In the inkjet head 10' shown in FIG. 13B in which the head modules 12 are arranged in the two-row staggered configuration, it is possible to extract the extraction wires 90 (or the FPC boards 91) from either end of each head module 12 in the lengthwise direction of each head module 12 (or the inkjet head 10'). According to this mode, it is possible to make efficient use of the gaps between the head modules 12.

Inner Structure of Inkjet Head

Figure 14A:
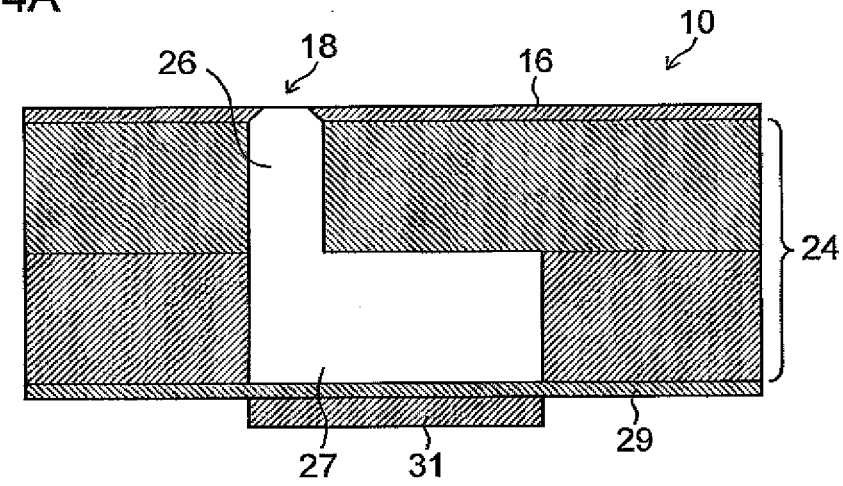
FIGS. 14A and 14B are cross-sectional diagrams showing the inner structures of the inkjet heads.
Figure 14B:
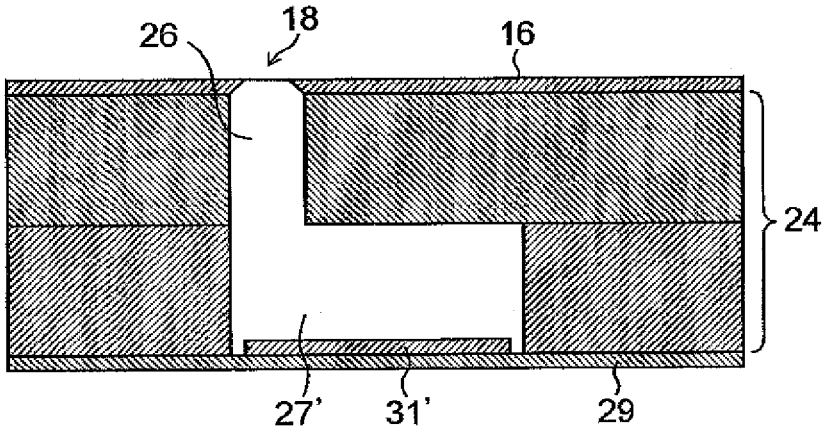

FIGS. 14A and 14B are cross-sectional diagrams showing the inner structures of embodiments of the inkjet head 10. FIG. 14A shows the embodiment in which a piezoelectric method is employed, and FIG. 14B shows the embodiment in which a thermal method is employed. In FIGS. 14A and 14B, the ink ejection direction is shown upward.

In the piezoelectric method shown in FIG. 14A, a piezoelectric element 31 is arranged at a position corresponding to the pressure chamber 27 of a diaphragm 29, which constitutes one wall (ceiling surface) of the pressure chamber 27. When a drive voltage is applied between an individual electrode and a common electrode (not shown) of the piezoelectric element 31, the piezoelectric element 31 bends and contracts the pressure chamber 27. Thereby, the ink of a volume corresponding to the reduction in the volume of the pressure chamber 27 is ejected from the pressure chamber 27 through the nozzle aperture 18. When the piezoelectric element 31 is returned to the original state from the bending state, the ink is refilled into the pressure chamber 27 from the common flow channel 69 (see FIGS. 7A and 7B) through a supply port (not shown).

In the thermal method shown in FIG. 14B, a heater 31' is arranged inside a liquid chamber 27', which is connected to the nozzle 26. When the heater 31' generates heat and produces a film boiling effect, the ink inside the liquid chamber 27' is ejected through the nozzle aperture 18. The ink ejection method is not limited to the piezoelectric method or the thermal method, and can employ another method.

In each of the inkjet head 10 shown in FIG. 14A and the inkjet head 10' shown in FIG. 14B, a mode that omits the nozzles 26 can be adopted.

The shapes of the detection wires 20 and 22 described with reference to FIGS. 8A to 11C, and the shapes of the extraction wires described with reference to FIGS. 12A to 13B, and to the inner structures of the inkjet heads described with reference to FIGS. 14A and 14B can be applied to any of the above-described first to third embodiments.

Composition of Liquid Ejection Apparatus

Next, a liquid ejection apparatus or an inkjet recording apparatus 100 which is equipped with the above-described inkjet head 10, 10', 40 or 60 is explained.

<General Composition>

Figure 15:
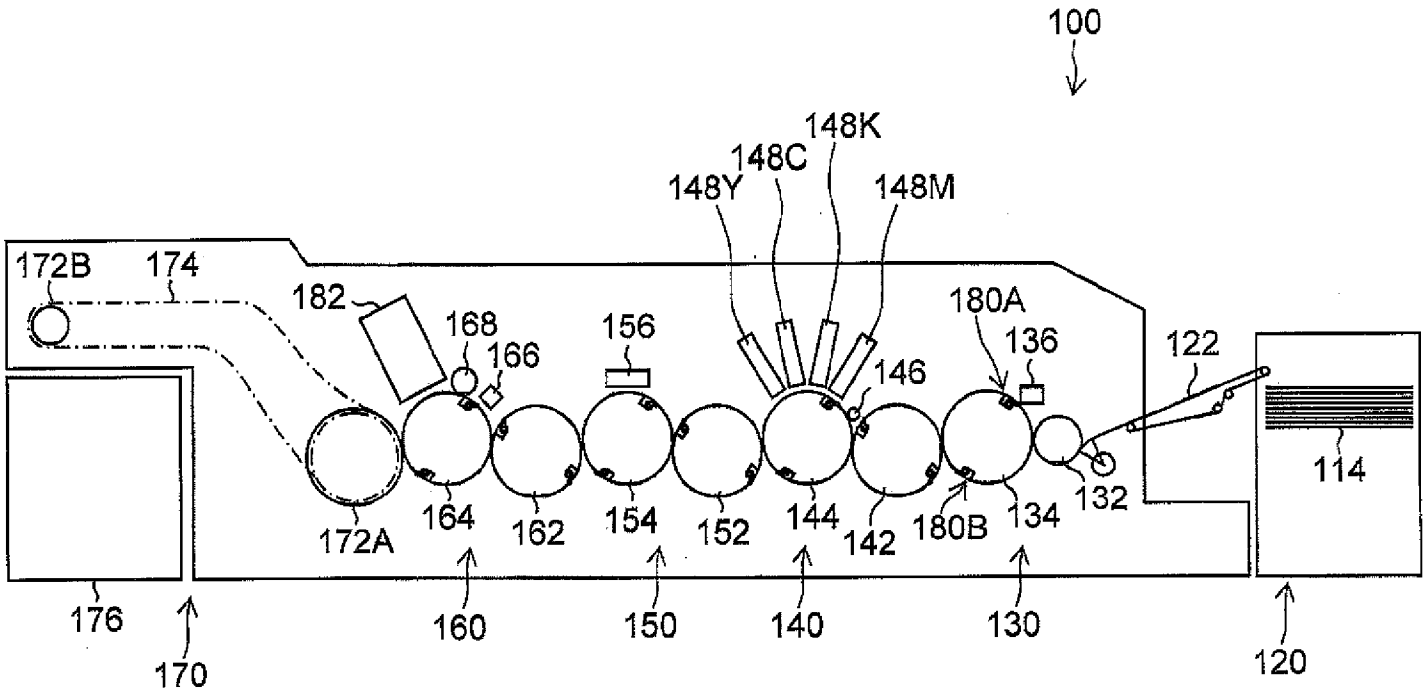
FIG. 15 is a general schematic drawing showing the composition of an inkjet recording apparatus according to an embodiment of the present invention.

FIG. 15 is a general schematic drawing showing the general composition of the inkjet recording apparatus 100 according to an embodiment of the present invention. The inkjet recording apparatus 100 shown in FIG. 15 employs a pressure drum conveyance method, which conveys a recording medium 114 while holding the recording medium 114 on an outer circumferential surface of a pressure drum.

The inkjet heads 148M, 148K, 148C and 148Y configured to eject and deposit droplets of inks of a plurality of colors (e.g., magenta (M), black (K), cyan (C) and yellow (Y)) to the recording medium 114 are arranged obliquely with respect to the horizontal plane, in such a manner that the nozzle surfaces thereof are perpendicular to the normal to the outer circumferential surface of the pressure drum (the image formation drum) 144. The inkjet heads 10, 10', 40 and 60 described above can be employed for the inkjet heads 148M, 148K, 148C and 148Y.

The inkjet recording apparatus 100 shown in FIG. 15 includes: a recording medium accommodation unit 120, in which recording media 114 are accommodated before image formation; a treatment liquid application unit 130, which applies treatment liquid to the recording medium 114 paid out from the recording accommodation unit 120; an image formation unit 140, which forms a desired color image by ejecting and depositing droplets of color inks onto the recording medium 114 on which the treatment liquid has been applied; a drying process unit 150, which dries the recording medium 114 on which the color image has been formed; a fixing process unit 160, which applies a fixing process to the recording medium 114 after the drying process; and an output unit 170, which outputs the recording medium 114 after the fixing process.

The recording medium 114 is transferred from the recording accommodation unit 120 through a paper supply tray 122 and a transfer drum 132 to a treatment liquid drum 134. The recording medium 114 is supported by the treatment liquid drum 134 while the leading end portion of the recording medium 114 is gripped by a gripper 180A or 180B of the treatment to liquid drum 134, and the recording medium 114 is conveyed about the outer circumferential surface of the treatment liquid drum 134 in accordance with the rotation of the treatment liquid drum 134.

When the recording medium 114 conveyed in rotation by the treatment liquid drum 134 reaches the processing region of a treatment liquid application device 136 arranged at a position opposing the outer circumferential surface of the treatment liquid drum 134, the treatment liquid is applied to the surface of the recording medium 114 where the image is to be formed. The treatment liquid applied by the treatment liquid application device 136 has a function of aggregating or insolubilizing the coloring agents included in the color inks by reacting with the color inks deposited from the inkjet heads 148M, 148K, 148C and 148Y.

The recording medium 114 on which the treatment liquid has been applied is transferred onto the image formation drum 144 thorough a transfer drum 142, and is held on the outer circumferential surface of the image formation drum 144 and conveyed in rotation along the outer circumferential surface of the image formation drum 144.

A paper pressing roller 146 is arranged immediately before the inkjet heads 148M, 148K, 148C and 148Y on the upstream side thereof in terms of the recording medium conveyance direction, and in such a manner that the recording medium 114 is caused to make tight contact with the outer circumferential surface of the image formation drum 144 by the paper pressing roller 146 immediately before entering directly below the inkjet heads 148M, 148K, 148C and 148Y.

The inkjet heads 148M, 148K, 148C and 148Y eject and deposit droplets of the color inks onto the image forming surface, on which the treatment liquid has been applied, of the recording medium 114 conveyed to rotate by the image formation drum 144, thereby forming a color image on the image forming surface of the recording medium 114.

Each of the inkjet heads 148M, 148K, 148C and 148Y has the structure in which the head modules 12 are joined together in one row along the lengthwise direction of the inkjet head as shown in FIG. 1 and FIG. 13A.

The recording medium 114 on which the color image has been formed is transferred to a drying drum 154 through a transfer drum 152, is supported by the outer circumferential surface of the drying drum 154, and is conveyed to rotate along the outer circumferential surface of the drying drum 154 in accordance with the rotation of the drying drum 154.

The recording medium 114 conveyed to rotate by the drying drum 154 is subjected to to a drying process by a drying device 156. For the drying process, either heating by a heater, drying air (hot air) blowing by a fan, or a combination of these, can be employed.

The recording medium 114 on which the drying process has been carried out is transferred to a fixing drum 164 through a transfer drum 162. The recording medium 114 that has been transferred to the fixing drum 164 is held on the outer circumferential surface of the drying drum 154, and is conveyed to rotate along the outer circumferential surface of the drying drum 154 in accordance with the rotation of the drying drum 154.

The image formed on the recording medium 114 conveyed to rotate by the drying drum 154 undergoes a heating process a heater 166, and also undergoes a pressing process by a fixing roller 168. An in-line sensor 182 arranged on the downstream side of the fixing roller 168 in terms of the recording medium conveyance direction is a device configured to capture an image of the recording medium 114 on which the fixing process by heating and pressing has been carried out, and ejection abnormalities in the inkjet heads 148M, 148K, 148C and 148Y are identified on the basis of the imaging results of the in-line sensor 182.

The recording medium 114 that has passed through the imaging region of the in-line sensor 182 is sent to the output unit 170. The output unit 170 is composed in such a manner that the recording medium 114 is conveyed to a stacker 176 by a chain 174 wrapped about tensioning rollers 172A and 172B.

<Composition of Print Unit>

The inkjet heads 148M, 148K, 148C and 148Y arranged in the image formation unit 140 are the full line-type inkjet heads in which the plurality of nozzles are arranged through the length exceeding the entire width of the recording medium 114. Each of the inkjet heads 148M, 148K, 148C and 148Y has the structure in which the plurality of head modules are joined together in the lengthwise direction (see FIGS. 1, 13A and 13B).

The inkjet heads 148M, 148K, 148C and 148Y shown in FIG. 15 are arranged in this sequence from the upstream side of the recording medium conveyance direction. It is possible to record an image over the whole area of the recording medium 114 by a single pass method, which moves the recording medium 114 relatively to the full line-type inkjet heads 148M, 148K, 148C and 148Y just once.

The image formation unit 140 is not limited to the mode described above. For instance, it is also possible to include inkjet heads corresponding to LC (light cyan) and LM (light magenta). Furthermore, the arrangement sequence of the inkjet heads 148M, 148K, 148C and 148Y can be changed appropriately.

Each of the inkjet heads 148M, 148K, 148C and 148Y can employ the piezoelectric method as shown in FIG. 14A or the thermal method as shown in FIG. 14B.

<Composition of Control System>

Figure 16:
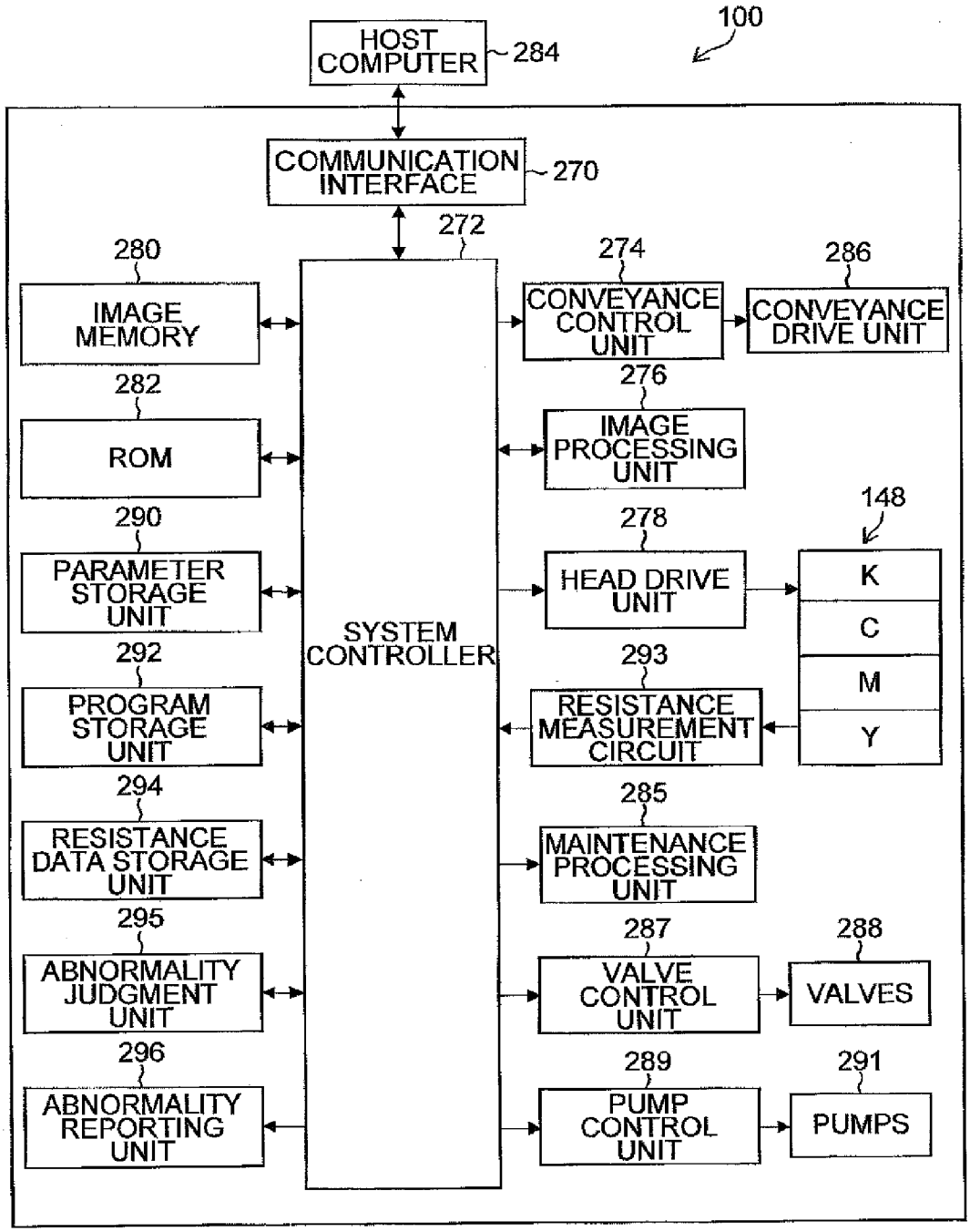
FIG. 16 is a block diagram showing the configuration of a control system in the inkjet recording apparatus in FIG. 15.

FIG. 16 is a block diagram showing the composition of the control system of the inkjet recording apparatus 100. As shown in FIG. 16, the inkjet recording apparatus 100 includes a communication interface 270, a system controller 272, a conveyance control unit 274, an image processing unit 276, a head drive unit 278, an image memory 280, a ROM 282, and the like.

The inkjet recording apparatus 100 further includes: the resistance measurement circuit 293, which measures the resistance values of the detection wires 20 and 22 formed on the nozzle plates 16 (see FIG. 2) of the inkjet heads 148 (which represent the inkjet heads 148M, 148K, 148C and 148Y shown in FIG. 15); a resistance data storage unit 294, in which data about the resistance values of the detection wires 20 and 22 is stored; an abnormality judgment unit 295, which judges the presence or absence of a mechanical abnormality on the nozzle plate 16 on the basis of the data about the resistance values of the detection wires 20 and 22 as measured by the resistance measurement circuit 293; and an abnormality reporting unit 296, which reports the fact that a mechanical abnormality has been detected in the nozzle plate 16.

The communication interface 270 is an interface unit for receiving raster image data transmitted from a host computer 284. The communication interface 270 can employ a serial interface, such as a USB (Universal Serial Bus), or a parallel interface, such as a Centronics device. It is also possible to install a buffer memory (not shown) for achieving high-speed communications in the communication interface 270.

The system controller 272 is constituted of a central processing unit (CPU) and peripheral circuits of same, and the like, and functions as a control device that controls the whole of the inkjet recording apparatus 100 in accordance with a prescribed program, as well as functioning as a calculating device that performs various calculations and also functioning as a memory controller for the image memory 280 and the ROM 282.

More specifically, the system controller 272 controls the various sections, such as the communication interface 270, the conveyance control unit 274, and the like, as well as controlling communications with the host computer 284 and reading and writing to and from to the image memory 280 and the ROM 282, and the like, and generating control signals for controlling the respective units described above.

The image data sent from the host computer 284 is inputted to the inkjet recording apparatus 100 through the communication interface 270, and prescribed image processing is carried out by the image processing unit 276.

The image processing unit 276 is a control unit having signal (image) processing functions for carrying out various treatments, corrections and other processing in order to generate a signal for controlling printing from the image data, and which supplies the generated print data (dot data) to the head drive unit 278.

When prescribed signal processing has been carried out in the image processing unit 276, the droplet volume to be ejected (droplet ejection volume) and the ejection timing of the inkjet heads 148 are controlled through the head drive unit 278 on the basis of the print data (halftone image data). The head drive unit 278 can be constituted of a plurality of blocks for the respective head modules 12.

Thereby, a desired dot size and dot arrangement are achieved. The head drive unit 278 shown in FIG. 16 can also include a feedback control system for maintaining uniform drive conditions in the inkjet heads 148.

The conveyance control unit 274 controls the conveyance timing and conveyance speed of the recording medium 114 (see FIG. 15) on the basis of print data generated by the image processing unit 276. A conveyance drive unit 286 in FIG. 16 includes motors which drive the pressure drums 134, 144, 154 and 165 and the transfer drums 132, 142, 152 and 162 for conveying the recording medium 114, and the conveyance control unit 274 functions as a driver for these motors.

The image memory (primary storage memory) 280 has the functions of a temporary storage device for temporarily storing image data input through the communication interface 270, and the functions of a development area for various programs stored in the ROM 282 and a calculation work area for the CPU (for example, a work area for the image processing unit 276). A volatile memory (RAM) which can be read from and written to sequentially is used as the image memory 280.

The ROM 282 stores the program to be executed by the CPU of the system controller 272, and various data and control parameters, and the like, which are necessary for controlling the respective sections of the inkjet recording apparatus 100, and reading and writing of the data from and to the ROM 282 is performed through the system controller 272. The ROM 282 is not limited to a memory such as a semiconductor element, and can also employ a magnetic medium, such as a hard disk. Furthermore, the storage unit can also include an external interface and use a detachable storage medium.

A maintenance processing unit 285 is a block which executes maintenance processing on the inkjet heads 148. Possible examples of the maintenance processing of the inkjet heads 148 include: a cleaning process of the ink ejection surface 16A (see FIG. 2), a purging (preliminary ejection) process which discharges the ink from the nozzles 26 (see FIGS. 14A and 14B) by operating the piezoelectric elements 31 (see FIG. 14A) or the heaters 31' (see FIG. 14B), or a suction process which sucks and discharges the ink from the nozzles 26 by placing a cap (not shown) in tight contact with the ink ejection surface 16A.

When the maintenance process is started, the inkjet heads 148 are moved from the image formation position opposing the outer circumferential surface of the image formation drum 144 (see FIG. 15) to a maintenance position and the process described above is applied to the inkjet heads 148, by means of a command signal sent from the system control unit 272.

When the process described above applied to the inkjet heads 148 is terminated, the inkjet heads 148 are moved from the maintenance position to the image formation position. The maintenance of the inkjet heads 148 can be carried out periodically during intervals between jobs or at the start of a job, or the like, and can be carried out upon receiving an input from an operator through a user interface (not shown).

A valve control unit 287 controls the opening and closing of each of valves 288 arranged in the liquid (e.g., ink) flow channels and vacuum flow channels, and the like, on the basis of command signals sent from the system controller 272. The valves 288 in FIG. 16 represent various valves which are arranged in the inkjet recording apparatus 100.

A pump control unit 289 controls the driving (e.g., turning on or off, and flow rate) of each of pumps 291 arranged in the liquid (e.g., ink) flow channels and vacuum flow channels, and the like, on the basis of command signals sent from the system controller 272. The pumps 291 in FIG. 16 represent various pumps which are arranged in the inkjet recording apparatus 100.

A parameter storage unit 290 stores various control parameters which are necessary for the operation of the inkjet recording apparatus 100. The system controller 272 reads out parameters required for control purposes, as appropriate, and updates (rewrites) parameters as and where necessary. The parameter storage unit 290 stores the standard resistance values of the detection wires 20 and 22.

A program storage unit 292 stores control programs for operating the inkjet recording apparatus 100. In controlling the respective units of the inkjet recording apparatus 100, the system control unit 272 (or the respective units of the inkjet recording apparatus 100 themselves) reads out the required control program from the program storage unit 292 and the control program is duly executed.

The resistance measurement circuit 293 measures the resistance values of the detection wires 20 and 22 formed on the nozzle plates 16 (see FIG. 2) of the inkjet heads 148. More specifically, an input unit of the resistance measurement circuit 293 is connected electrically to the detection wires 20 and 22 through the extraction wires 90 (see FIG. 11C) or the FPC boards 91 (see FIG. 12B).

The resistance measurement circuit 293 measures separately the resistance values of the detection wires 20 and 22 formed on the nozzle plates 16, in accordance with a prescribed sampling period. The resistance values of the detection wires 20 and 22 formed on the nozzle plates 16 are measured by the resistance measurement circuit 293 during operation of the inkjet heads (during image formation), while the inkjet heads are halted (at standby, during maintenance), at the start and end of operation of the inkjet recording apparatus 100, and so on.

The measured resistance value data of each of the detection wires 20 and 22 is stored in the resistance data storage unit 294. In the mode including the plurality of head modules 12, it is identified in which head module 12 (i.e., nozzle plate 16) of the plurality of head modules 12 an abnormality has occurred.

It is also possible to adopt a composition in which the standard resistance values of the detection wires 20 and 22 stored in the parameter storage unit 290 are rewritten periodically with the measured resistance values of the detection wires 20 and 22 obtained by the resistance measurement circuit 293.

The abnormality judgment unit 295 compares the resistance values of the detection wires 20 and 22 stored in the resistance data storage unit 294 with the standard resistance values of the detection wires 20 and 22 stored in the parameter storage unit 290, and if any of the measured resistance values of the detection wires 20 and 22 is larger than the corresponding one of the standard resistance values, then it is judged that a mechanical abnormality, such as cracking or deformation, of the nozzle plate 16 has occurred, and this judgment result is sent to the system controller 272.

When the nozzle plate 16 in which the mechanical abnormality, such as cracking or deformation, has occurred is detected by the abnormality judgment unit 295, the system controller 272 sends information about the nozzle plate 16 in which the abnormality has occurred, to the abnormality reporting unit 296.

Furthermore, in the mode shown in the second embodiment (see FIG. 6A), it is identified at which position in the nozzle plate 42 the abnormality has occurred, and information about the position where the abnormality has occurred is sent conjointly to the system controller 272.

Upon acquiring the information indicating that the mechanical abnormality such as cracking or deformation has occurred in the nozzle plate 16, from the system controller 272, the abnormality reporting unit 296 issues a reporting about this information. The mode of the reporting by the abnormality reporting unit 296 can employ an alarm sound, a voice, text characters, flashing (blinking) lights, or the like.

For example, in a composition including a monitor display, it is possible to display information indicating that the abnormality has occurred in any one of the head modules 12, by figures or images on the monitor display.

If the nozzle plate 16 in which the abnormality has occurred is detected, then the system controller 272 issues command signals to the respective units of the inkjet recording apparatus 100 in order to carry out the processing described below. More specifically, if the mechanical abnormality has been detected in the nozzle plate 16, in order to prevent secondary damage to the respective units of the inkjet recording apparatus 100, the system controller 272 functions as an abnormality processing device to cause the respective units of the inkjet recording apparatus 100 to execute particular sequences, which include, for example:

(1) A movement unit for moving the inkjet heads 148 in the upward/downward direction is operated so that the inkjet heads 148 are moved upward and separated from the recording medium;

(2) A command signal is issued to the head drive unit 278 so that the drive signal to the head module 12 having the nozzle plate 16 that is judged to have the abnormality is halted, and the occurrence of an ejection abnormality from the head module 12 is thereby prevented;

(3) The power supply of the head module 12 having the nozzle plate 16 that is judged to have the abnormality is turned off to prevent effects on the drive circuit substrate (the substrate on which the head drive unit 278, and the like, is mounted);

(4) A command signal is issued to the valve control unit 287 so that the supply of the ink to the head module 12 having the nozzle plate 16 that is judged to have the abnormality is shut off, thereby preventing leakage of the ink; and (5) A command signal is issued to the maintenance processing unit 285 so that if maintenance of the inkjet heads 148 is underway, then the maintenance processing of the head module 12 having the nozzle plate 16 that is judged to have the abnormality is not executed, in order to prevent damage to the other head modules 12. This is because, if the ink ejection surface 16A is wiped in a state where shards from rupturing of the nozzle plate 16, as well as dirt, and the like, have adhered to the nozzle plate 16, then these shards, and the like, adhere to the wiping member and there is a risk of causing scratches when the ink ejection surface 16A of another head module 12 is wiped.

Thus, when the abnormality in the nozzle plate 16 is detected, the command signals are sent to the respective units of the inkjet recording apparatus 100 instructing the execution of prescribed processing, so that problems caused by the abnormality in the nozzle plate 16 (ink leakage, breakdown of the drive circuit, and the like) can be avoided in advance.

Figure 17:
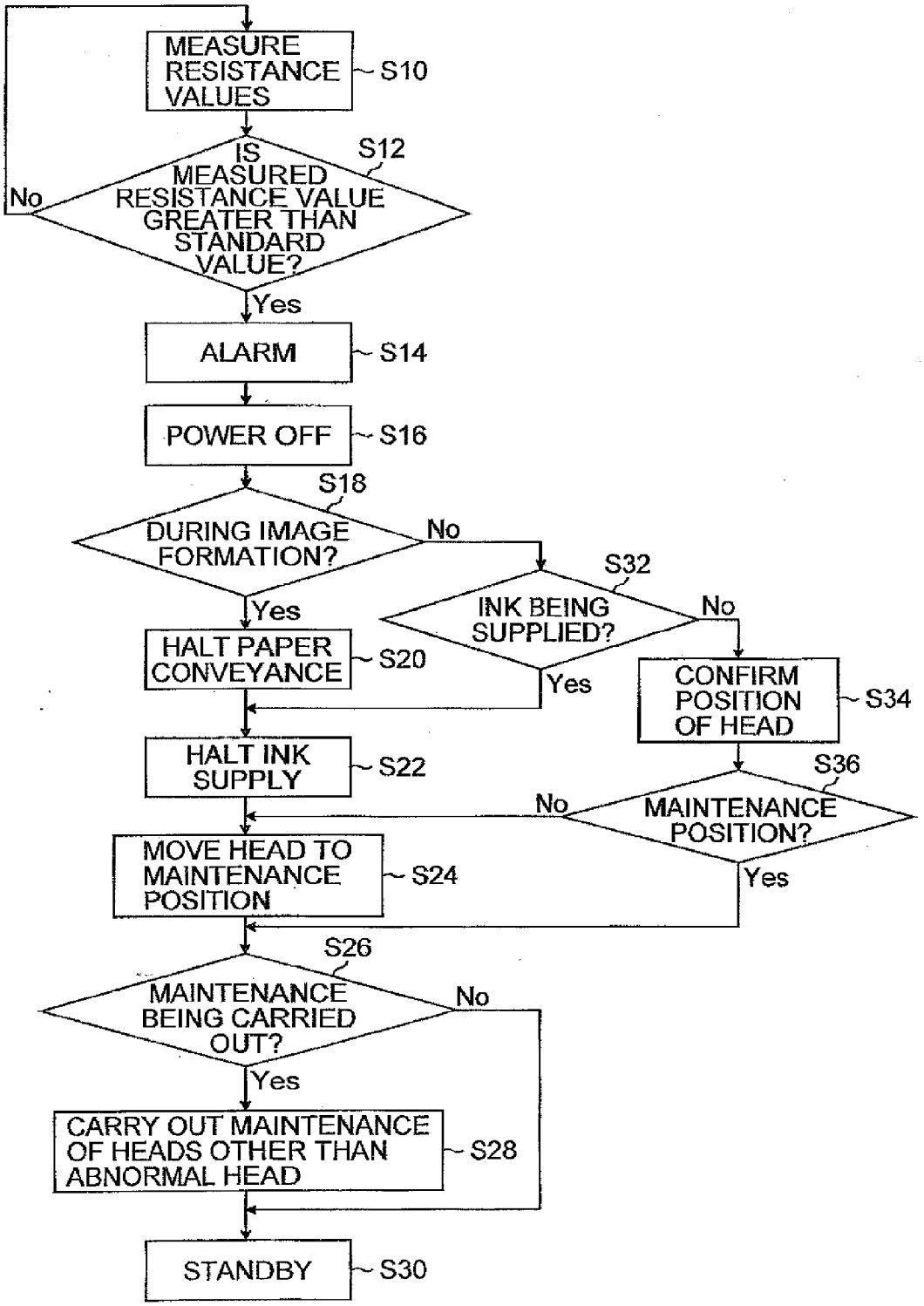
FIG. 17 is a flowchart showing a control sequence for detecting abnormality in the nozzle plate employed in the inkjet recording apparatus in FIG. 15.

FIG. 17 is a flowchart showing a sequence of control in the abnormality detection method for the nozzle plate 16 described above. As described previously, while the inkjet recording apparatus 100 is operating, at the least, the resistance values of the detection wires 20 and 22 formed on the nozzle plates 16 are measured by the resistance measurement circuit 293 in the prescribed sampling period (step S10).

If the measured resistance values of the detection wires 20 and 22 are not larger than the standard resistance values (NO verdict) in step S12, then the measurement of the detection wires 20 and 22 is continued (step S10). On the other hand, in step S12, if it is judged that any of the measured resistance values of the detection wires 20 and 22 is larger than the corresponding one of the standard resistance values (YES verdict), then an alarm is issued by the abnormality reporting unit 296 (step S14), and the power supply to the head module 12 having the nozzle plate 16 where the abnormality has been detected is turned off (step S16).

Thereupon, the procedure advances to step S18, and it is judged whether or not image formation is underway (during operation of the inkjet heads 148), and if image formation is underway (YES verdict), the conveyance of the recording medium (paper) is halted (step S20), and the ink supply to the head module 12 having the nozzle plate 16 judged to have the abnormality is halted (step S22).

Subsequently, the inkjet heads 148 are moved from the image formation position to the maintenance position (step S24), and it is judged whether or not maintenance is carried out on the inkjet heads 148 (step S26). If it is judged in step S26 that maintenance is carried out (YES verdict), then maintenance processing of the head modules 12 other than the head module 12 having the nozzle plate 16 judged to have the abnormality is carried out (step S28), and the inkjet heads 148 are transferred to a standby state (step S30).

On the other hand, if it is judged in step S26 that maintenance of the inkjet head 148 is not executed (NO verdict), then the inkjet head 148 is transferred to the standby state (step S30). In this state, it is possible to replace the head module 12 having the nozzle plate 16 judged to have the abnormality.

If it is judged in step S18 that image formation is not underway (NO verdict), then it is judged whether or not the ink is being supplied to the head module 12 having the nozzle plate 16 judged to have the abnormality (step S32). If the ink is being supplied (YES verdict), the procedure advances to step S22, the ink supply is halted, and the processing from step S24 to step S30 is executed.

On the other hand, if no ink is being supplied (NO verdict), the procedure advances to step S34, the position of the inkjet heads 148 is confirmed, and it is judged whether or not the inkjet heads 148 are in the maintenance position or the image formation position (step S36). If it is judged in step S36 that the inkjet heads 148 are in the image formation position (NO verdict), then the procedure advances to step S24, the inkjet heads 148 are moved to the maintenance position, and the processing from step S26 to step S30 is executed.

If it is judged in step S36 that the position of the inkjet heads 148 is the maintenance position (YES verdict), then the procedure advances to step S26, and the processing from step S26 to step S30 is executed.

The program for executing the abnormality detection method for the nozzle plate is stored in the program storage unit 292 in FIG. 16. The system controller 272 reads out the execution program from the program storage unit 292, as appropriate, and executes the abnormality detection method for the nozzle plate described above.

According to the inkjet recording apparatus 100 having the composition described above, the detection wires 20 and 22 are arranged on the nozzle plates 16 of the head modules 12 constituting the inkjet heads 148, and it is judged whether or not a mechanical abnormality, such as cracking or deformation, has occurred in the nozzle plates 16, on the basis of change in the resistance values of the detection wires 20 and 22. If a nozzle plate 16 having an abnormality is detected, than a report to this effect is issued, and processing is carried out to withdraw the inkjet head 148, halt the ink supply, halt the application of the drive voltage, and the like, thereby minimizing the effects caused to the respective units of the inkjet recording apparatus 100 by the abnormality in the nozzle plate 16.

Furthermore, it is possible to halt the inkjet recording apparatus 100 rapidly and to replace the head module 12 having the nozzle plate 16 in which the abnormality has occurred.

In the apparatus composition according to the embodiment of the present invention, the pressure drum conveyance method, which holds and conveys the recording medium on the outer circumferential surface of the image formation drum 144 is described, but the embodiment of the present invention can also be applied to a mode where a recording medium is linearly conveyed. In the pressure drum conveyance method, the end portion of the recording medium is liable to float up and therefore collide with the inkjet head 148 (ink ejection surface 16A), and if the recording medium 114 collides with the ink ejection surface 16A, then a mechanical abnormality is liable to occur in the nozzle plate 16, and hence the embodiment of the present invention can display particularly great beneficial effects in the composition which employs a pressure drum conveyance method.

The present embodiment principally describes the inkjet recording apparatus 100 provided with the inkjet heads having the similar composition to the inkjet head 10 (10') according to the first embodiment, but it is also possible to employ the inkjet head 40 according to the second embodiment and the inkjet head 60 according to the third embodiment.

Furthermore, it is also preferable that the inkjet heads 10, 10', 40 and 60 according to the first to third embodiments are appropriately combined.

Fourth Embodiment

Figure 18A:
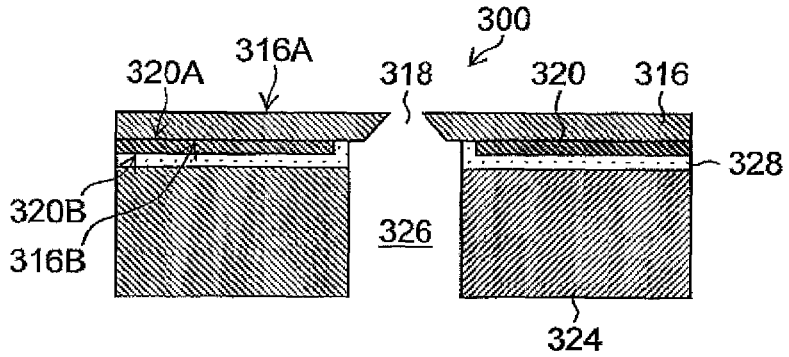
FIG. 18A is a cross-sectional diagram showing the inner structure of an inkjet head according to a fourth embodiment of the present invention.

Next, a fourth embodiment of the present invention is described. FIG. 18A is a cross-sectional diagram showing the inner structure of an inkjet head 300 according to the fourth embodiment, and FIG. 18B is a plan view perspective diagram of one nozzle portion of the inkjet head 300.

Figure 18B:
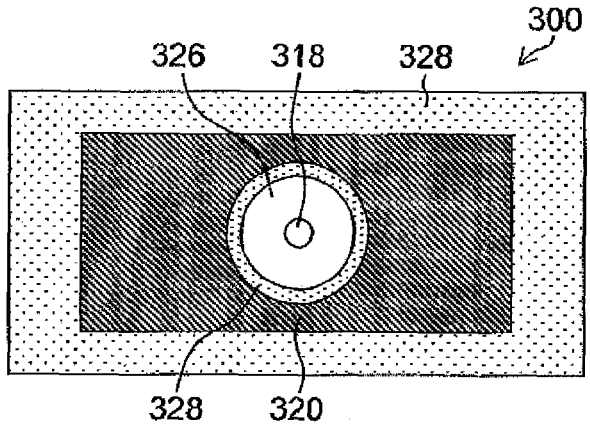
FIG. 18B is a plan view perspective diagram of a nozzle portion of the inkjet head in FIG. 18A.

The inkjet head 300 shown in FIGS. 18A and 18B is provided with piezoelectric elements 320 as devices for detecting a mechanical abnormality, such as cracking or deformation, in a nozzle plate 316.

The piezoelectric elements 320 are arranged between the nozzle plate 316 and a flow channel plate 324. Each piezoelectric element 320 has a first electrode 320A arranged on the surface of the piezoelectric element 320 facing the nozzle plate 316 and a second electrode 320B arranged on the surface of the piezoelectric element 320 facing the flow channel plate 324. The first electrode 320A and the second electrode 320B are electrically connected to extraction electrodes (not shown) arranged on the end portions of the nozzle plate 316, through wires arranged in the nozzle plate 316.

The properties decline if the piezoelectric elements 320, the first electrodes 320A and the second electrodes 320B come into contact with the ink inside the nozzles 326, and therefore these elements are covered with a protective member 328 made of resin, or the like. It is also possible to protect the piezoelectric elements 320 by covering with the adhesive that bonds the piezoelectric elements 320.

If the nozzle plate 316 receives an impact, then an electrical signal corresponding to the force applied to the piezoelectric element 320 occurs between the first electrode 320A and the second electrode 320B of the piezoelectric element 320. Hence, by constantly monitoring the electrical signal generated between the first electrode 320A and the second electrode 320B of the piezoelectric element 320, it is possible to judge whether or not a mechanical abnormality has occurred in the nozzle plate 316 on the basis of the variation in this electrical signal.

In the mode provided with the piezoelectric elements 320 as the devices which detect a mechanical abnormality in the nozzle plates 316, a voltage measurement circuit that measures the voltages generated by the piezoelectric elements 320 is arranged instead of the resistance value measurement circuit 293 in FIG. 16, a reference voltage data storage unit that stores the reference voltages of the piezoelectric elements is arranged instead of the resistance data storage unit 294, and the abnormality judgment unit 295 compares the voltage measurement values with the reference voltages, and can determine that an abnormality has occurred in the nozzle plate 316 if the voltage measurement value is greater than the corresponding reference voltage.

FIGS. 18A to 18B show the mode where the piezoelectric element 320 is arranged on the surface 316B of the nozzle plate 316 on the side opposite to the ink ejection surface 316A, but the piezoelectric element 320 can be arranged on the ink ejection surface 316A. If the piezoelectric element 320 is arranged on the ink ejection surface 316, then the piezoelectric element 320 is covered with a protective film in such a manner that the piezoelectric element 320 (and the electrode) is not exposed.

The piezoelectric elements 320 can be arranged over the whole surface of the nozzle plate 316, or can be patterned as in the detection wires 20 and 22 shown in FIG. 2, and the like, and arranged in a portion of the nozzle plate 316.

In the present embodiment, the piezoelectric element 320 is given as an example of a mechanical-electrical transducer that converts an impact applied to the nozzle plate 316 into an electrical signal, but it is also possible to employ a vibration sensor or distortion sensor of various types.

<Application of the Fourth Embodiment>

Figure 19:
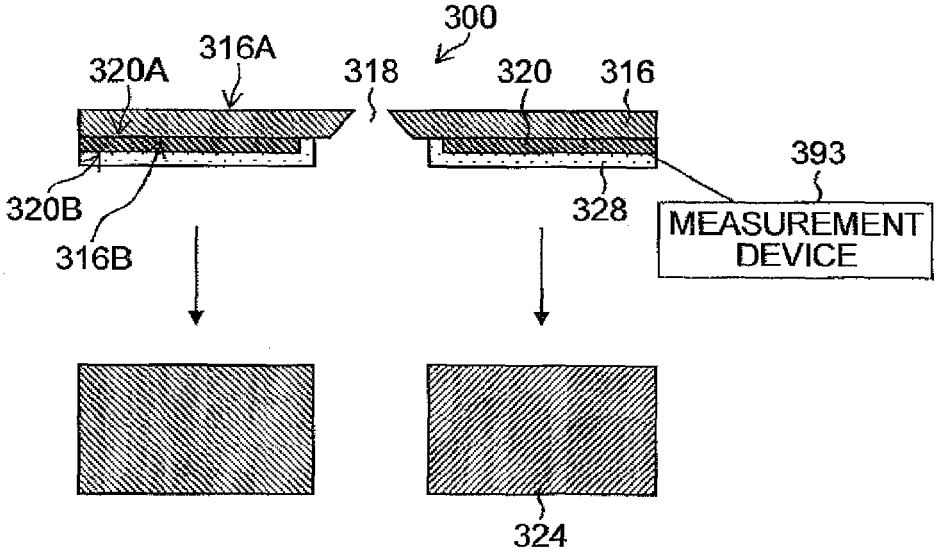
FIG. 19 is an illustrative diagram of an application of the fourth embodiment.

FIG. 19 is an illustrative diagram of an application of the fourth embodiment of the present invention. In the mode in which the piezoelectric elements 320 are arranged on the surface 316B of the nozzle plate 316 on the opposite side to the ink ejection surface 316A as shown in FIGS. 18A and 18B, it is possible to measure the load when bonding the nozzle plate 316 and the flow channel 324, by means of the piezoelectric elements 320.

By measuring the load when bonding the nozzle plate 316 and the flow channel plate 324 and correcting the load between the nozzle plate 316 and the flow channel plate 324 so as to be uniform, it is possible to bond the nozzle plate 316 and the flow channel plate 324 in a uniform manner.

For instance, if an external measurement device 393 is connected in advance to the electrodes (not shown) of the piezoelectric elements 320, as shown in FIG. 19, then by monitoring the measurement values of the external measurement device 393, it is possible to identify the load when bonding the nozzle plate 316 and the flow channel plate 324.

The scope of application of the present invention is not limited to the inkjet recording apparatus, which forms a color image on a recording medium. For example, the present invention can also be applied broadly to liquid ejection apparatuses provided with the inkjet heads, such as pattern forming apparatuses, which form prescribed patterns (mask patterns, wiring patterns) by functional liquids containing resin particles and metal particles.

It should be understood that there is no intention to limit the invention to the specific forms disclosed, but on the contrary, the invention is to cover all modifications, alternate to constructions and equivalents falling within the spirit and scope of the invention as expressed in the appended claims.

What is claimed is:

1. A liquid ejection apparatus, comprising:

a liquid ejection head including: a nozzle plate formed with a nozzle aperture through which liquid is ejected; and a flow channel plate formed with at least a flow channel connected to the nozzle aperture, the flow channel plate being bonded to the nozzle plate with the flow channel aligned to the nozzle aperture in the nozzle plate, the nozzle plate being provided with a detection element configured to detect a mechanical abnormality in the nozzle plate; and a detection device configured to detect the mechanical abnormality in the nozzle plate in accordance with information obtained from the detection element wherein:

a first surface of the nozzle plate is bonded with the flow channel plate;

the detection element includes at least one of a first electrical wire arranged on the first surface of the nozzle plate and a second electrical wire arranged on a second surface of the nozzle plate opposite to the first surface; and the detection device includes: a measurement unit configured to measure a resistance value of the at least one of the first and second electrical wires; and a judgment unit configured to judge whether or not the mechanical abnormality has occurred in the nozzle plate in accordance with change in the resistance value of the at least one of the first and second electrical wires obtained by the measurement unit.

2. The liquid ejection apparatus as defined in claim 1, wherein:

the flow channel plate has a liquid chamber and a flow channel, the liquid chamber connecting to the nozzle aperture in the nozzle plate, the flow channel connecting to the liquid chamber;

the at least one of the first and second electrical wires is arranged to intersect with the flow channel;

the at least one of the first and second electrical wires has a shape formed of a broad width section and a narrow width section, the broad width section including a portion of greatest width, the narrow width section having a width less than that of the broad width section; and the narrow width section is arranged at a position corresponding to the flow channel.

* * * * *